US011851854B2

(12) United States Patent
Chiba et al.

(10) Patent No.: US 11,851,854 B2
(45) Date of Patent: Dec. 26, 2023

(54) WORK MACHINE

(71) Applicant: HITACHI CONSTRUCTION MACHINERY CO., LTD., Tokyo (JP)

(72) Inventors: Takaaki Chiba, Kasumigaura (JP); Hisami Nakano, Tsuchiura (JP); Hiroaki Tanaka, Kasumigaura (JP); Manabu Edamura, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 51 days.

(21) Appl. No.: 17/734,252

(22) Filed: May 2, 2022

(65) Prior Publication Data

US 2022/0259834 A1 Aug. 18, 2022

Related U.S. Application Data

(63) Continuation of application No. 16/328,895, filed as application No. PCT/JP2017/032171 on Sep. 6, 2017, now abandoned.

(51) Int. Cl.
*E02F 9/26* (2006.01)
*E02F 3/32* (2006.01)
(Continued)

(52) U.S. Cl.
CPC ..... *E02F 9/265* (2013.01); *E02F 3/32* (2013.01); *E02F 3/435* (2013.01); *E02F 9/2203* (2013.01); *E02F 9/2271* (2013.01); *E02F 9/262* (2013.01)

(58) Field of Classification Search
None
See application file for complete search history.

(56) References Cited

U.S. PATENT DOCUMENTS 5,835,874 A 11/1998 Hirata
2018/0313062 A1 11/2018 Tsukamoto

FOREIGN PATENT DOCUMENTS

JP 2000-291076 A 10/2000
JP 2017-014726 A 1/2017
(Continued)

OTHER PUBLICATIONS

International Search Report of PCT/JP2017/032171 dated Oct. 3, 2017.

(Continued)

*Primary Examiner* — Maceeh Anwari
*Assistant Examiner* — Charles Pall
(74) *Attorney, Agent, or Firm* — MATTINGLY & MALUR, PC

(57) ABSTRACT

An hydraulic excavator calculates an estimated excavation volume Va defined by a bucket claw tip position (first position) at an excavation start, a bucket claw tip position (second position) at an excavation end set in advance, a current landform, a first target surface, and a bucket width w. A second target surface is generated at a position superior to the first target surface when the estimated excavation volume Va exceeds a limit volume Vb; and the second target surface is generated at a position at which the excavation volume defined by the first position, the second position, the current landform, the second target surface, and the bucket width is closer to the limit volume Vb. The hydraulic actuators are controlled such that an operating range of a work implement is limited on the second target surface and to an area superior to the second target surface.

5 Claims, 19 Drawing Sheets

(51) Int. Cl.
*E02F 3/43* (2006.01)
*E02F 9/22* (2006.01)

(56) References Cited

FOREIGN PATENT DOCUMENTS

| | | | |
|---|---|---|---|
| WO | 95/30059 | A1 | 11/1995 |
| WO | 2017/002749 | A1 | 1/2017 |
| WO | 2017/115810 | A1 | 7/2017 |

OTHER PUBLICATIONS

International Preliminary Report on Patentability received in corresponding International Application No. PCT/JP2017/032171 dated Mar. 19, 2020.

WORK MACHINE

TECHNICAL FIELD

The present invention relates to a work machine capable of performing machine control.

BACKGROUND ART

A hydraulic excavator may be provided with a control system assisting an excavation operation performed by an operator. Specifically, when an excavation operation (e.g., an arm crowding command) is input via an operation device, a known control system performs control to force at least one of a boom cylinder, an arm cylinder, and a bucket cylinder that drive a work machine to operate (e.g., to extend the boom cylinder to thereby forcibly perform a boom raising operation) such that, on the basis of a positional relation between a target surface and a distal end (e.g., bucket claw tip) of the work machine, the distal end of the work machine (to be referred to also as a front work implement) is held at a position on the target surface or within an area superior to the target surface. Limiting the area through which the distal end of the work machine can move as described above facilitates work to finish an excavation surface or work to form a slope face.

Patent Document 1, for example, discloses a type of control, in which a target speed vector of a bucket distal end is calculated using a signal from an operation device (operation lever) and the boom cylinder is controlled such that a vector component having a direction approaching the target surface in the target speed vector decreases at distances closer to the target surface to thereby hold a front work implement within a deceleration area (set area) set superior to the target surface (a boundary of the set area). Such a type of control may be referred in the following to as "machine control (MC)," "area limiting control," or "intervention control (with respect to an operator operation)."

From a viewpoint of increasing efficiency in excavation work performed by the work machine, preferably, an excavation amount for each excavation operation is continuously maximized. Patent Document 2 discloses a work assist system for a work machine that includes a controller and a display device. The work assist system operates as follows. Specifically, in a situation in which excavation is performed according to what is called a bench cut method, the excavation amount (estimated excavation amount) to be housed in a bucket per one excavation operation by the work implement is set and an area from which the estimated excavation amount can be obtained from an excavation object by one excavation operation is established as an excavation area S. The controller uses the excavation area S to calculate a work position Pw of the work machine when the work machine performs the next excavation operation. The display device displays information on the work position of the work machine calculated by the controller. The technique disclosed in Patent Document 2 aims, by displaying the next work position in the display device, at maintaining the excavation amount for each excavation operation even when a height (bench height) H of the excavation object on which the work machine is placed varies.

PRIOR ART DOCUMENT

Patent Document

Patent Document 1: WO1995/030059
Patent Document 2: JP-2017-14726-A

SUMMARY OF THE INVENTION

Problem to be Solved by the Invention

The technique disclosed in Patent Document 2 establishes the excavation area S on the basis of a cross-sectional area sb and a bench height H of the excavation area S from which the excavation object is to be excavated in the next excavation operation. The technique further assumes that the excavation area S is a parallelogram and calculates the next work position Pw from a distance (excavation amount setting distance) Ls that is calculated using an assumption that $sb=H \cdot Ls$ holds. Specifically, the technique calculates the work position Pw on the assumption that the bench height H is a predetermined value. If, in the next excavation operation, the work machine starts excavating with a position closer to the work machine than the predetermined bench height H, however, the excavation amount falls short of the estimated excavation amount (target excavation amount) even when the work machine is located at the work position Pw calculated by the controller. This can result in reduced work efficiency.

While the technique disclosed in Patent Document 2 assumes excavation by the bench cut method, the same can be pointed out for a case in which, as in Patent Document 1, the target surface (flat surface) is generated through the excavation operation. For example, a method is possible in which an excavation start point and an excavation end point are established in advance in a fore-aft direction of the front work implement to thereby set a distance over which the bucket moves in one excavation operation (excavation distance). A target surface is then set at a predetermined depth as measured from a current landform (excavation depth) such that the single excavation operation can excavate a targeted excavation amount (target excavation amount (which corresponds to the estimated excavation amount in Patent Document 1)) and the excavation is performed toward the target surface. Because this method determines the excavation depth (target surface) on the basis of the predetermined excavation distance, however, an excavation operation performed on the basis of the same target surface when the excavation distance is changed (e.g., when the excavation operation cannot be started with the predetermined excavation start point), the resultant excavation amount may be more or less than the target excavation amount.

An object of the present invention is to provide a work machine that, while reducing a load on an operator during excavation work for generating a target surface, can prevent an excavation amount from being more or less than a target excavation amount (limit volume) regardless of an excavation distance.

Means for Solving the Problem

While the present application includes a plurality of means for solving the above problem, one aspect of the present application provides a work machine that includes: a work implement having a bucket, an arm, and a boom; a plurality of hydraulic actuators that drive the work implement; operation devices that instruct the hydraulic actuators on operations; and a controller that controls the hydraulic actuators such that, during operations of the operation devices, an operating range of the work implement is limited on a predetermined first target surface and to an area superior to the first target surface. In the work machine, the controller includes: a storage section that stores position information of a current landform; a bucket position calculation section that calculates a position of a claw tip of the bucket; an estimated excavation volume calculation section that calculates an estimated excavation volume defined by a first position that assumes the position of the claw tip of the bucket calculated by the bucket position calculation section at an excavation start, a second position that assumes the position of the claw tip of the bucket at an excavation end set in advance, the current landform, the first target surface, and a width of the bucket; and a target surface generation section that generates, when the estimated excavation volume exceeds a limit volume set in advance, a second target surface at a position superior to the first target surface. The target surface generation section generates the second target surface at a position at which the excavation volume defined by the first position, the second position, the current landform, the second target surface, and the width of the bucket is closer to the limit volume. When the second target surface is generated, the controller controls the hydraulic actuators such that the operating range of the work implement is limited on the second target surface and to an area superior to the second target surface.

Advantages of the Invention

In accordance with the present invention, the target surface is set such that the target excavation amount is maintained even with the excavation distance varying for each excavation sequence. The excavation amount can thus be prevented from being more or less than the target excavation amount (limit volume), so that efficiency in excavation work can be enhanced.

MODES FOR CARRYING OUT THE INVENTION

Figure 1:
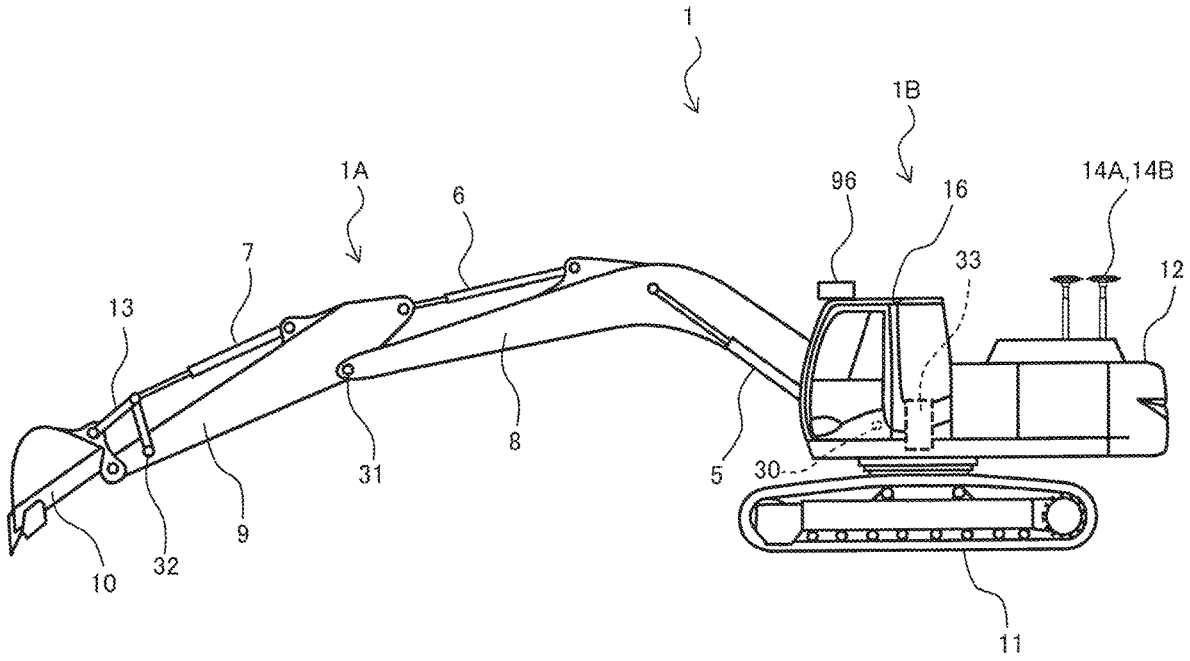
FIG. 1 is a configuration diagram of a hydraulic excavator.

Embodiments of the present invention will be described below with reference to the accompanying drawings. The following embodiments exemplify a hydraulic excavator having a bucket 10 as an attachment fitted at the distal end of a work implement. The present invention may nonetheless be applied to a work machine having any other attachment than the bucket. Furthermore, the present invention may be applied to any type of work machine other than the hydraulic excavator when the work machine includes an articulated work implement consisting of a plurality of link members (an attachment, an arm, a boom, and the like) connected with each other.

In this description, phrases used with terms denoting shapes (e.g., a target surface, a design surface, and the like), such as "on," "superior to," and "inferior to," mean as detailed below, specifically, "on" denotes a "surface" of the shape, "superior to" denotes a "position superior to, or above, the surface" of the shape, and "inferior to" denotes a "position inferior to, or below, the surface" of the shape. Additionally, in the description that follows, when a certain element is provided in plurality, an alphabet may be added at the end of a reference character (numeral) to differentiate one from the other. The alphabet may nonetheless be omitted, and the elements of the same kind may be denoted collectively. For example, three pumps 300*a*, 300*b*, and 300*c* may be collectively denoted as a pump 300.

<General Configuration of Hydraulic Excavator>

Figure 2:
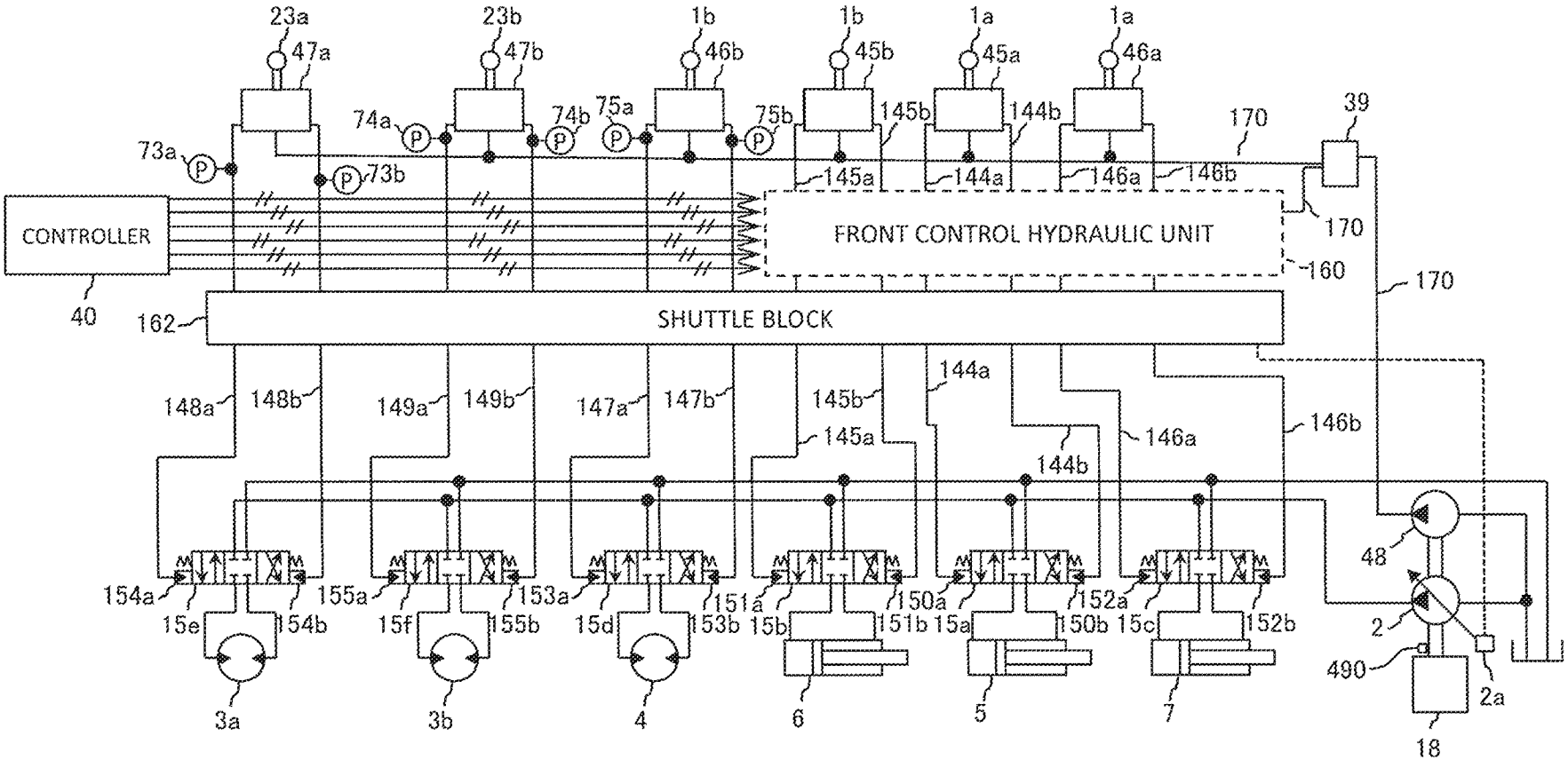
FIG. 2 is a diagram of a controller for the hydraulic excavator and a hydraulic drive system.
Figure 3:
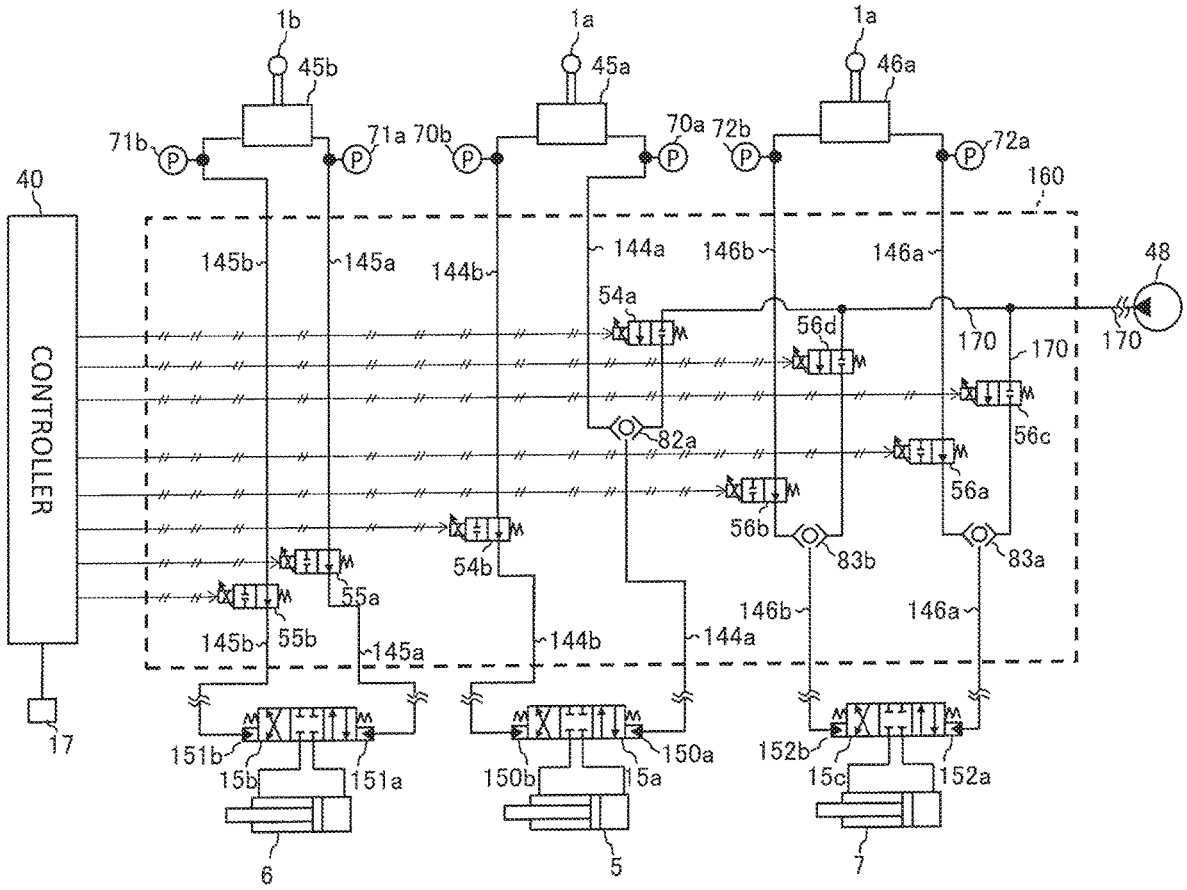
FIG. 3 is a diagram detailing a front control hydraulic unit 160 illustrated in FIG. 2.

FIG. 1 is a configuration diagram of a hydraulic excavator according to an embodiment of the present invention. FIG. 2 is a diagram of a controller for the hydraulic excavator according to the embodiment and a hydraulic drive system. FIG. 3 is a diagram detailing a front control hydraulic unit 160 illustrated in FIG. 2.

Reference is made to FIG. 1. This hydraulic excavator 1 includes an articulated front work implement 1A and a machine body 1B. The machine body 1B includes a lower track structure 11 and an upper swing structure 12. The lower track structure 11 travels as driven by left and right track hydraulic motors 3*a* and 3*b* (see FIG. 2 for the hydraulic motor 3*a*). The upper swing structure 12 is mounted on the lower track structure 11 and swung by a swing hydraulic motor 4.

The front work implement 1A includes a plurality of driven members (a boom 8, an arm 9, and a bucket 10) that are coupled with each other. The driven members each rotate in a vertical direction. The boom 8 has a proximal end rotatably supported via a boom pin at a front portion of the upper swing structure 12. The arm 9 is rotatably coupled with a distal end of the boom 8 via an arm pin. The bucket 10 is rotatably coupled with a distal end of the arm 9 via a bucket pin. The boom 8 is driven by a boom cylinder 5. The arm 9 is driven by an arm cylinder 6. The bucket 10 is driven by a bucket cylinder 7.

A boom angle sensor 30 is mounted on the boom pin. An arm angle sensor 31 is mounted on the arm pin. A bucket angle sensor 32 is mounted on a bucket link 13. The boom angle sensor 30, the arm angle sensor 31, and the bucket angle sensor 32 measure rotation angles α, β, and γ (see FIG. 5) of the boom 8, the arm 9, and the bucket 10, respectively. A machine body inclination angle sensor 33 is mounted on the upper swing structure 12. The machine body inclination angle sensor 33 detects an inclination angle θ (see FIG. 5) of the upper swing structure 12 (machine body 1B) with respect to a reference plane (e.g., a horizontal plane). It is noted that the angle sensors 30, 31, and 32 are replaceable with respective angle sensors detecting angles with respect to reference planes (e.g., the horizontal plane).

An operation device 47*a* (FIG. 2), an operation device 47*b* (FIG. 2), operation devices 45*a* and 46*a* (FIG. 2), and operation devices 45*b* and 46*b* (FIG. 2) are mounted in a cab 16 disposed in the upper swing structure 12. The operation device 47*a* includes a right track lever 23*a* (FIG. 2) and operates the right track hydraulic motor 3*a* (lower track structure 11). The operation device 47*b* includes a left track lever 23*b* (FIG. 2) and operates the left track hydraulic motor 3*b* (lower track structure 11). The operation devices 45*a* and 46*a* share a right operation lever 1*a* (FIG. 2) and operate the boom cylinder 5 (boom 8) and the bucket cylinder 7 (bucket 10). The operation devices 45*b* and 46*b* share a left operation lever 1*b* (FIG. 2) and operate the arm cylinder 6 (arm 9) and the swing hydraulic motor 4 (upper swing structure 12). In the following, the right track lever 23*a*, the left track lever 23*b*, the right operation lever 1*a*, and the left operation lever 1*b* may be collectively referred to as operation levers 1 and 23.

An engine 18 as a prime mover mounted on the upper swing structure 12 drives a hydraulic pump 2 and a pilot pump 48. The hydraulic pump 2 is a variable displacement pump having displacement controlled by a regulator 2*a*. The pilot pump 48 is a fixed displacement pump. In the present embodiment, a shuttle block 162 is disposed midway in pilot lines 144, 145, 146, 147, 148, and 149, as illustrated in FIG. 2. Hydraulic signals output from operation devices 45, 46, and 47 are applied also to the regulator 2*a* via the shuttle block 162. While a detailed configuration of the shuttle block 162 is omitted, briefly, the hydraulic signal is applied to the regulator 2*a* via the shuttle block 162 and a delivery flow rate of the hydraulic pump 2 is controlled according to the hydraulic signal.

A pump line 170 as a delivery line of the pilot pump 48 is branched after a lock valve 39 to be connected with respective valves in the operation devices 45, 46, and 47 and the front control hydraulic unit 160. The lock valve 39 in the embodiment is a solenoid-operated changeover valve having a solenoid drive section electrically connected with a position sensor of a gate lock lever (not illustrated) disposed in the cab 16 of the upper swing structure 12. The position sensor detects a position of the gate lock lever and applies a signal corresponding to the position of the gate lock lever to the lock valve 39. When the gate lock lever is in a locked position, the lock valve 39 closes to interrupt the pump line 170. When the gate lock lever is in an unlocked position, the lock valve 39 opens to establish communication of the pump line 170. Specifically, when the pump line 170 is interrupted, an operation by the operation devices 45, 46, and 47 is disabled and swing, excavation, and other operations are prohibited.

The operation devices 45, 46, and 47 are each a hydraulic pilot type operation device. On the basis of hydraulic fluid delivered from the pilot pump 48, each of the operation devices 45, 46, and 47 generates a pilot pressure (may be referred to also as an operation pressure) corresponding to an operation amount (e.g., lever stroke) and an operating direction of the operation levers 1 and 23 operated by an operator. The pilot pressures thus generated are supplied via pilot lines 144*a* to 149*b* (see FIG. 3) to respective hydraulic drive sections 150*a* to 155*b* of flow control valves 15*a* to 15*f* (see FIG. 2 or 3) associated with respective control valve units (not illustrated) and used as control signals that drive the flow control valves 15*a* to 15*f*.

The hydraulic fluid delivered from the hydraulic pump 2 is supplied via the flow control valves 15*a*, 15*b*, 15*c*, 15*d*, 15*e*, and 15*f* (see FIG. 3) to the right track hydraulic motor 3*a*, the left track hydraulic motor 3*b*, the swing hydraulic motor 4, the boom cylinder 5, the arm cylinder 6, and the bucket cylinder 7. The boom cylinder 5, the arm cylinder 6, and the bucket cylinder 7 are extended or contracted by the hydraulic fluid thus supplied, so that the boom 8, the arm 9, and the bucket 10 are rotated, and the position and posture of the bucket 10 vary. The hydraulic fluid thus supplied rotates the swing hydraulic motor 4, to thereby swing the upper swing structure 12 relative to the lower track structure 11. The hydraulic fluid thus supplied rotates the right track hydraulic motor 3*a* and the left track hydraulic motor 3*b* to thereby cause the lower track structure 11 to travel.

Figure 4:
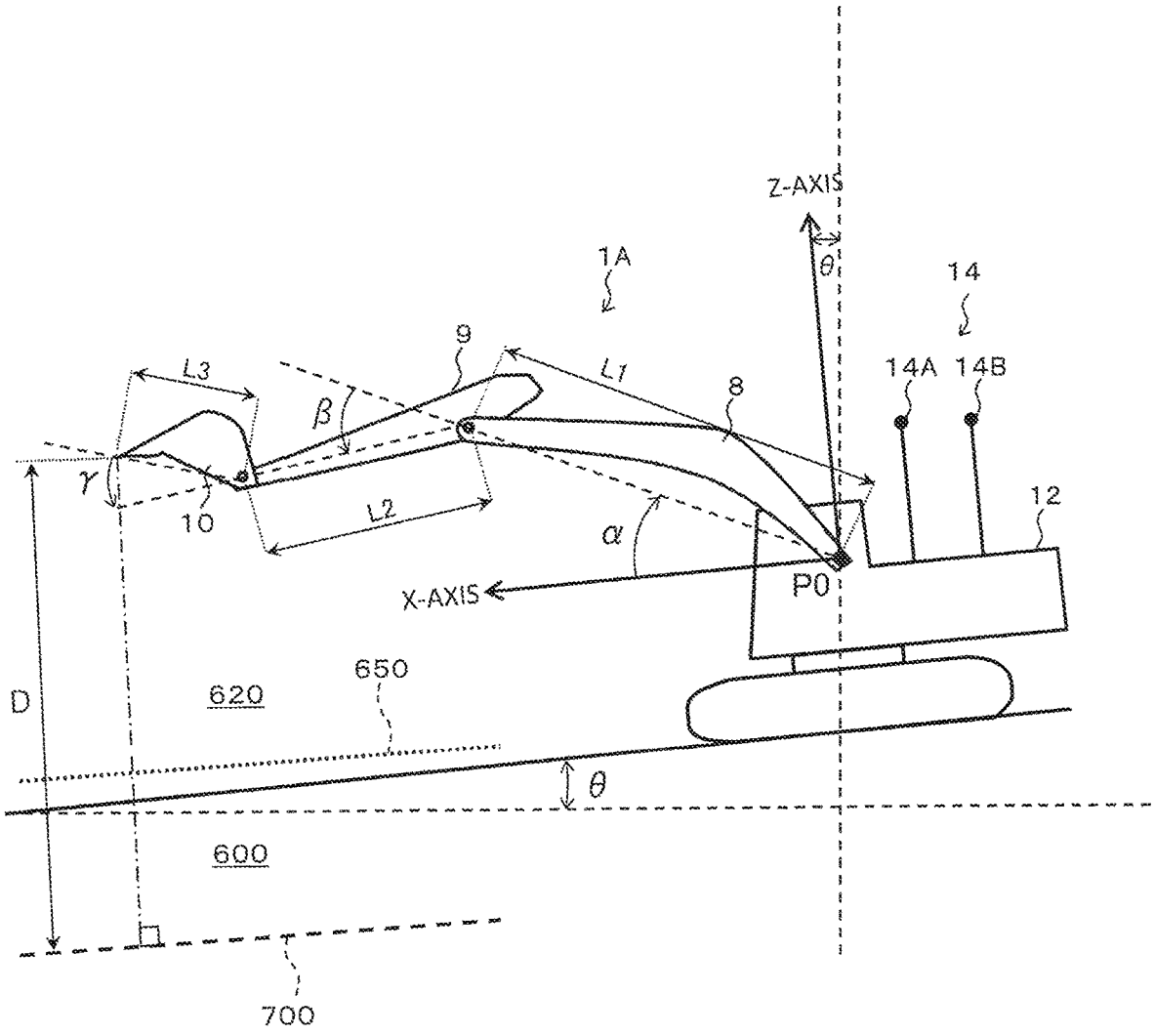
FIG. 4 is a diagram of a coordinate system in the hydraulic excavator illustrated in FIG. 1 and a target surface (first target surface).

A posture of the work implement 1A can be defined on the basis of an excavator coordinate system (local coordinate system) illustrated in FIG. 4. The excavator coordinate system illustrated in FIG. 4 is set on the upper swing structure 12. A base portion of the boom 8 is defined as an origin PO, and in the upper swing structure 12, a Z-axis is set in a vertical direction and an X-axis is set in a horizontal direction. Additionally, a Y-axis is defined in a direction specified by the X-axis and the Z-axis in a right-handed system. An inclination angle of the boom 8 with respect to the X-axis is defined as a boom angle α. An inclination angle of the arm 9 with respect to the boom is defined as an arm angle β. An inclination angle of the bucket claw tip with respect to the arm is defined as a bucket angle γ. An inclination angle of the machine body 1B (upper swing structure 12) with respect to a horizontal plane (reference plane) is defined as an inclination angle θ. The boom angle α is detected by the boom angle sensor 30. The arm angle θ is detected by the arm angle sensor 31. The bucket angle γ is detected by the bucket angle sensor 32. The inclination angle θ is detected by the machine body inclination angle sensor 33. The boom angle α is a minimum when the boom 8 is raised to a maximum (the boom cylinder 5 is at a stroke end in a raising direction, specifically, a boom cylinder length is the longest), and is a maximum when the boom 8 is lowered to a minimum (the boom cylinder 5 is at a stroke end in a lowering direction, specifically, the boom cylinder length is shortest). The arm angle β is a minimum when an arm cylinder length is the shortest and a maximum when the arm cylinder length is the longest. The bucket angle γ is a minimum when a bucket cylinder length is the shortest (the condition illustrated in FIG. 4) and a maximum when the bucket cylinder length is the longest. Let L1 denote a length between the base portion of the boom 8 and a connection of the boom 8 with the arm 9, let L2 denote a length between the connection of the arm 9 with the boom 8 and a connection of the arm 9 with the bucket 10, and let L3 denote a length between the connection of the arm 9 with the bucket 10 and a distal end portion of the bucket 10. Then, the position of the distal end of the bucket 10 in the excavator coordinate system may be given by expressions (1) and (2) given below, where $X_{bk}$ is the position in an X-direction and $Z_{bk}$ is the position in a Z-direction.

[Math. 1]

$$X_{bk} = L_1\cos(\alpha) + L_2\cos(\alpha+\beta) + L_3\cos(\alpha+B+\gamma) \quad \text{Expression (1)}$$

[Math. 2]

$$Z_{bk} = L_1\sin(\alpha) + L_2\sin(\alpha+\beta) + L_3\sin(\alpha+\beta+\gamma) \quad \text{Expression (2)}$$

As illustrated in FIG. 1, the hydraulic excavator 1 includes a pair of global navigation satellite system (GNSS) antennas 14A and 14B disposed on the upper swing structure 12. The position of the hydraulic excavator 1 and the position of the bucket 10 in a global coordinate system can be calculated on the basis of information from the GNSS antenna 14.

Figure 5:
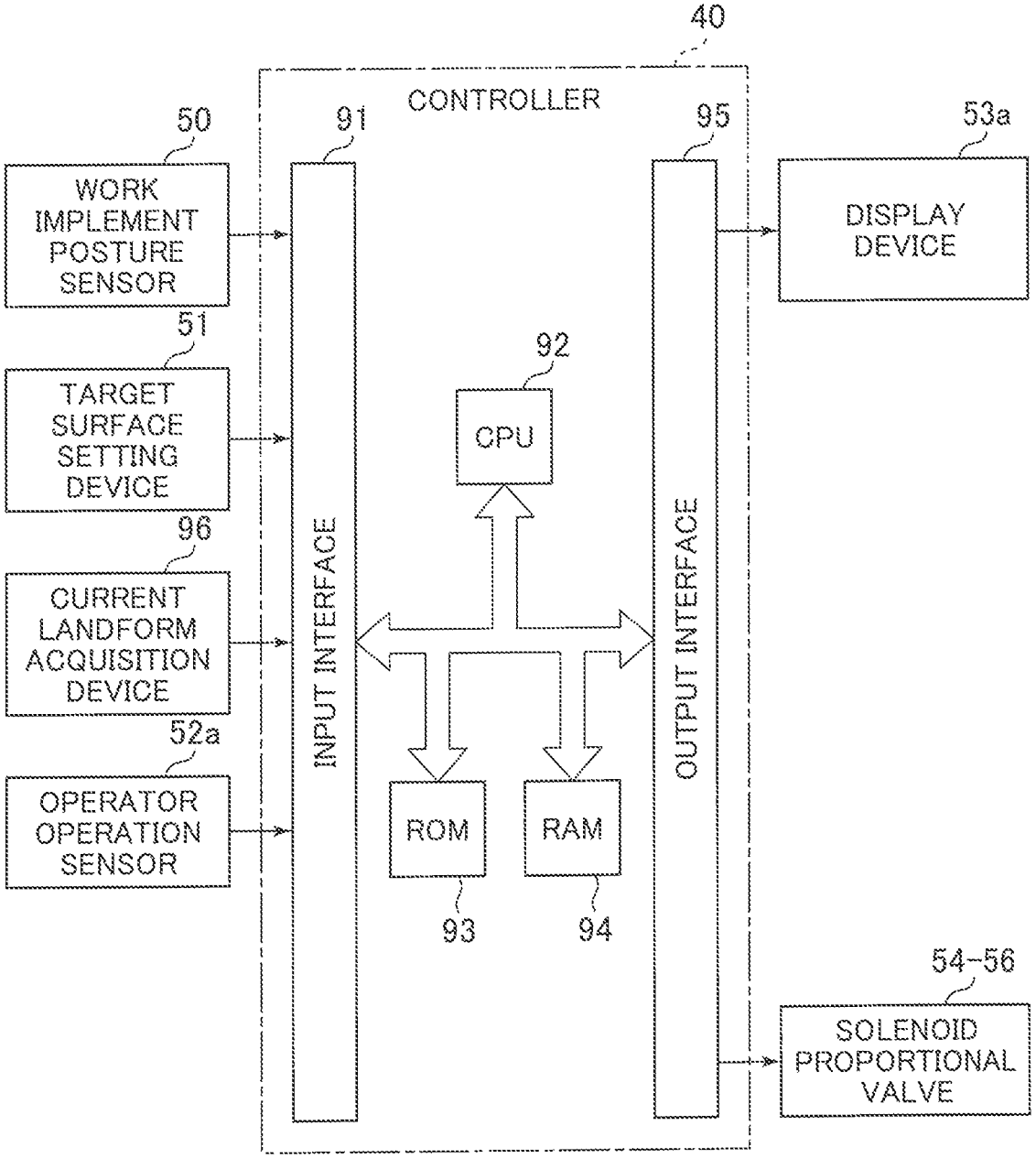
FIG. 5 is a hardware configuration diagram of a controller 40 for the hydraulic excavator.

FIG. 5 is a configuration diagram of a machine guidance (MG) and machine control (MC) system included in the hydraulic excavator according to the embodiment.

As MC provided by this system for the front work implement 1A, control is performed to operate the work implement 1A in accordance with a predetermined condition when the operation devices 45*a*, 45*b*, and 46*a* are operated and the work implement 1A is located in a deceleration area (first area) 600, which represents a predetermined closed area set superior to an arbitrarily set target surface 700 (see FIG. 4). Specifically, as the MC provided at this time, at least one of the hydraulic actuators 5, 6, and 7 is controlled such that, in the deceleration area 600, a vector component having a direction approaching the target surface 700 in a speed vector at a distal end portion (e.g., the claw tip of the bucket 10) of the work implement 1A decreases at distances of the distal end portion of the work implement 1A closer to the target surface 700 (details will be given later). The hydraulic actuator 5, 6, or 7 is controlled by forcibly outputting a control signal (e.g., extend the boom cylinder 5 to thereby forcibly perform a boom raising operation) to a corresponding one of the flow control valves 15*a*, 15*b*, and 15*c*. This MC prevents the claw tip of the bucket 10 from entering a zone inferior to the target surface 700, so that excavation in line with the target surface 700 can be performed regardless of the level of expertise of the operator. The MC is not performed when the work implement 1A is located in a non-deceleration area (second area) 620 set superior to the deceleration area 600 and adjacent to the deceleration area 600, and the work implement 1A operates as operated by the operator. In FIG. 4, the dotted line 650 denotes a boundary between the deceleration area 600 and the non-deceleration area 620.

In the present embodiment, a control point of the front work implement 1A during MC is set at the claw tip of the bucket 10 (distal end of the work implement 1A) of the hydraulic excavator. The control point may, however, be changed to any point other than the bucket claw tip as long as the point falls within the distal end portion of the work implement 1A. For example, a bottom surface of the bucket 10 or an outermost portion of the bucket link 13 may also be selected. Alternatively, a point on the bucket 10 at a distance closest from the target surface 700 may be configured as the control point as appropriate.

Additionally, in this description, the MC may be referred to as "semi-automatic control" in which the operation of the work implement 1A is controlled by a controller 40 only when the operation devices 45 and 46 are operated, as against "automatic control" in which the operation of the work implement 1A is controlled by the controller 40 when the operation devices 45 and 46 are not operated.

Figure 15:
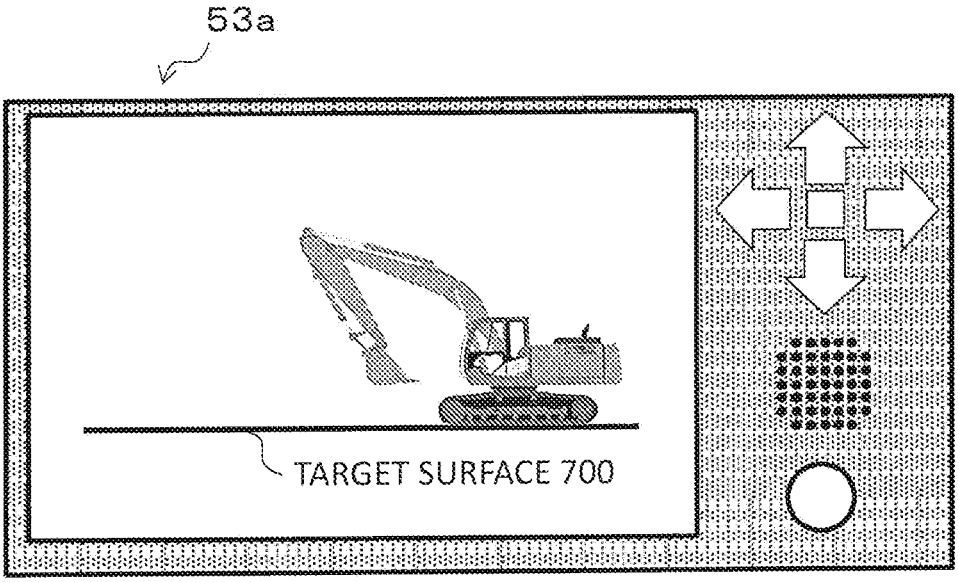
FIG. 15 is a diagram of an example of a configuration diagram of a display device 53*a*.

As MG provided by this system for the front work implement 1A, processing is performed, in which a positional relation between the target surface 700 and the work implement 1A (e.g., bucket 10) is displayed on a display device 53*a* as illustrated in FIG. 15, for example.

The system illustrated in FIG. 5 includes a work implement posture sensor 50, a target surface setting device 51, an operator operation sensor 52*a*, the display device 53*a*, a current landform acquisition device 96, and the controller 40. The display device 53*a* is disposed in the cab 16 and can display the positional relation between the target surface 700 and the work implement 1A. The current landform acquisition device 96 acquires position information of a current landform 800 which the work implement 1A is to work on. The controller 40 controls MG and MC.

The work implement posture sensor 50 is formed to include the boom angle sensor 30, the arm angle sensor 31, the bucket angle sensor 32, and the machine body inclination angle sensor 33. These angle sensors 30, 31, 32, and 33 function as posture sensors of the work implement 1A.

The target surface setting device 51 is an interface through which information on the target surface 700 (including position information and inclination angle information on each target surface) can be input. The target surface setting device 51 is connected with an external terminal (not illustrated) that stores three-dimensional data of the target surface defined on the global coordinate system (absolute coordinate system). The input of the target surface via the target surface setting device 51 may be made manually by the operator.

The operator operation sensor 52*a* is formed to include pressure sensors 70*a*, 70*b*, 71*a*, 71*b*, 72*a*, and 72*b*. The pressure sensors 70*a*, 70*b*, 71*a*, 71*b*, 72*a*, and 72*b* acquire operation pressures (first control signals) developing in the pilot lines 144, 145, and 146 as a result of the operator's operating the operation levers 1*a* and 1*b* (operation devices 45*a*, 45*b*, and 46*a*). Specifically, the pressure sensors 70*a*, 70*b*, 71*a*, 71*b*, 72*a*, and 72*b* detect operations on the hydraulic cylinders 5, 6, and 7 relating to the work implement 1A.

A stereo camera, a laser scanner, or an ultrasonic sensor, for example, provided in the excavator 1 may be used as the current landform acquisition device 96. These devices measure a distance between the excavator 1 and a point on the current landform. The current landform acquired by the current landform acquisition device 96 is defined by an enormous amount of point group position data. Alternatively, the current landform acquisition device 96 may be configured as an interface such that three-dimensional data of the current landform is acquired in advance by, for example, a drone in which a stereo camera, a laser scanner, an ultrasonic sensor, or the like is mounted, for loading the three-dimensional data in the controller 40.

<Front Control Hydraulic Unit 160>

Reference is made to FIG. 3. The front control hydraulic unit 160 includes the pressure sensors 70*a* and 70*b*, a solenoid proportional valve 54*a*, a shuttle valve 82*a*, and a solenoid proportional valve 54*b*, disposed in the pilot lines 144*a* and 144*b* of the operation device 45*a* for the boom 8. The pressure sensors 70*a* and 70*b* detect the pilot pressures (first control signals) as operation amounts of the operation lever 1*a*. The solenoid proportional valve 54*a* has a primary port side connected with the pilot pump 48 via the pump line 170 and reduces and outputs the pilot pressure from the pilot pump 48. The shuttle valve 82*a* is connected with the pilot line 144*a* of the operation device 45*a* for the boom 8 and a secondary port side of the solenoid proportional valve 54*a*. The shuttle valve 82*a* selects a high-pressure side of the pilot pressure in the pilot line 144*a* and a control pressure (second control signal) output from the solenoid proportional valve 54*a* and guides the high-pressure side to the hydraulic drive section 150*a* of the flow control valve 15*a*. The solenoid proportional valve 54*b* is disposed in the pilot line 144*b* of the operation device 45*a* for the boom 8 and reduces and outputs the pilot pressure (first control signal) in the pilot line 144*b* on the basis of a control signal from the controller 40.

The front control hydraulic unit 160 further includes the pressure sensors 71*a* and 71*b*, a solenoid proportional valve 55*b*, and a solenoid proportional valve 55*a*, disposed in the pilot lines 145*a* and 145*b* for the arm 9. The pressure sensors 71*a* and 71*b* detect the pilot pressures (first control signals) as operation amounts of the operation lever 1*b* and output the pilot pressures to the controller 40. The solenoid proportional valve 55*b* is disposed in the pilot line 145*b* and reduces and outputs the pilot pressure (first control signal) on the basis of the control signal from the controller 40. The solenoid proportional valve 55*a* is disposed in the pilot line 145*a* and reduces and outputs the pilot pressure (first control signal) in the pilot line 145*a* on the basis of the control signal from the controller 40.

The front control hydraulic unit 160 further includes the pressure sensors 72*a* and 72*b*, solenoid proportional valves 56*a* and 56*b*, solenoid proportional valves 56*c* and 56*d*, and shuttle valves 83*a* and 83*b*, disposed in the pilot lines 146*a* and 146*b* for the bucket 10. The pressure sensors 72*a* and 72*b* detect the pilot pressures (first control signals) as operation amounts of the operation lever 1*a* and output the pilot pressures to the controller 40. The solenoid proportional valves 56*a* and 56*b* reduce and output the pilot pressures (first control signals) on the basis of a control signal from the controller 40. The solenoid proportional valves 56*c* and 56*d* each have a primary port side connected with the pilot pump 48 and each reduce and output the pilot pressure from the pilot pump 48. The shuttle valves 83*a* and 83*b* select a high-pressure side of the pilot pressures in the pilot lines 146*a* and 146*b* and control pressures output from the solenoid proportional valves 56*c* and 56*d* and guide the high-pressure side to the hydraulic drive sections 152*a* and 152*b* of the flow control valve 15*c*. It is noted that FIG. 3 omits illustrating connection lines between the pressure sensors 70, 71, and 72 and the controller 40 for want of space.

The solenoid proportional valves 54*b*, 55*a*, 55*b*, 56*a*, and 56*b* each open at a maximum angle when not energized and reduce an opening degree with an increasing value of current as the control signal from the controller 40. The solenoid proportional valves 54*a*, 56*c*, and 56*d* reduce the opening degree to zero when not energized and each start opening when energized to increase the opening degree with an increasing value of current (control signal) from the controller 40. Specifically, the solenoid proportional valves 54, 55, and 56 each have an opening degree corresponding to the control signal from the controller 40.

In the control hydraulic unit 160 configured as described above, driving the solenoid proportional valve 54*a*, 56*c*, or 56*d* by outputting the control signal from the controller 40 allows the pilot pressure (second control signal) to be generated even without an operation performed by the operator on the corresponding operation device 45*a* or 46*a*, so that a boom raising operation, a bucket crowding operation, or a bucket dumping operation can be forcibly generated. Similarly, driving the solenoid proportional valve 54*b*, 55*a*, 55*b*, 56*a*, or 56*b* using the controller 40 allows the pilot pressure (second control signal) that represents reduction from the pilot pressure (first control signal) generated through an operation performed by the operator on the operation device 45*a*, 45*b*, or 46*a* to be generated, so that the speed at which a boom lowering operation, an arm crowding/dumping operation, or a bucket crowding/dumping operation is performed can be forcibly reduced from the value of the operator's operation.

In this description, of the control signals for the flow control valves 15*a* to 15*c*, the pilot pressures generated through operations on the operation devices 45*a*, 45*b*, and 46*a* are referred to as the "first control signals." Of the control signals for the flow control valves 15*a* to 15*c*, the pilot pressures generated through correction (reduction) of the first control signals made through driving of the solenoid proportional valves 54*b*, 55*a*, 55*b*, 56*a*, and 56*b* with the controller 40 and the pilot pressures generated differently from the first control signals through driving of the solenoid proportional valves 54*a*, 56*c*, and 56*d* with the controller 40 are referred to as the "second control signals."

The second control signal is generated when the speed vector of a control point of the work implement 1A generated by the first control signal contradicts a predetermined condition. The second control signal is generated as a control signal that generates a speed vector of the control point of the work implement 1A not contradicting the predetermined condition. When the first control signal is generated for one of the hydraulic drive sections in one of the flow control valves 15*a* to 15*c* and the second control signal is generated for the other one of the hydraulic drive sections, the second control signal is to preferentially act on the hydraulic drive section. Thus, the first control signal is interrupted by the solenoid proportional valve and the second control signal is applied to the other one of the hydraulic drive sections. Thus, of the flow control valves 15*a* to 15*c*, one for which the second control signal is calculated is controlled on the basis of the second control signal, one for which the second control signal is not calculated is controlled on the basis of the first control signal, and one for which neither the first nor the second control signal is generated is not controlled (driven). The above definitions of the first control signal and the second control signal result in the MC being referred to also as control of the flow control valves 15*a* to 15*c* on the basis of the second control signal.

<Controller>

Reference is made to FIG. 5. The controller 40 includes an input interface 91, a central processing unit (CPU) 92 as a processor, a read only memory (ROM) 93 and a random access memory (RAM) 94 as storage devices, and an output interface 95. Signals from the angle sensors 30 to 32 and the inclination angle sensor 33, which serve as the work implement posture sensor 50, a signal from the target surface setting device 51, which serves as a device for setting the target surface 700, and a signal from the current landform acquisition device 96, which acquires the current landform 800, are applied to the input interface 91. The CPU 92 performs conversion to enable calculation. The ROM 93 is a recording medium that stores a control program for performing MC and MG including processing relating to flowcharts to be described later and various types of information required for performing steps of the flowcharts. The CPU 92 performs predetermined computational processing for signals fetched from the input interface 91, the ROM 93, and the RAM 94 in accordance with the control program stored in the ROM 93. The output interface 95 generates an output signal in accordance with results of calculations performed by the CPU 92 and outputs the signal to the display device 53*a* to thereby activate the display device 53*a*.

It is noted that, although the controller 40 illustrated in FIG. 5 includes semiconductor memories of the ROM 93 and the RAM 94 as the storage devices, any other type of storage device may be substitutable. For example, the controller 40 may include a magnetic storage device, such as a hard disk drive.

Figure 6:
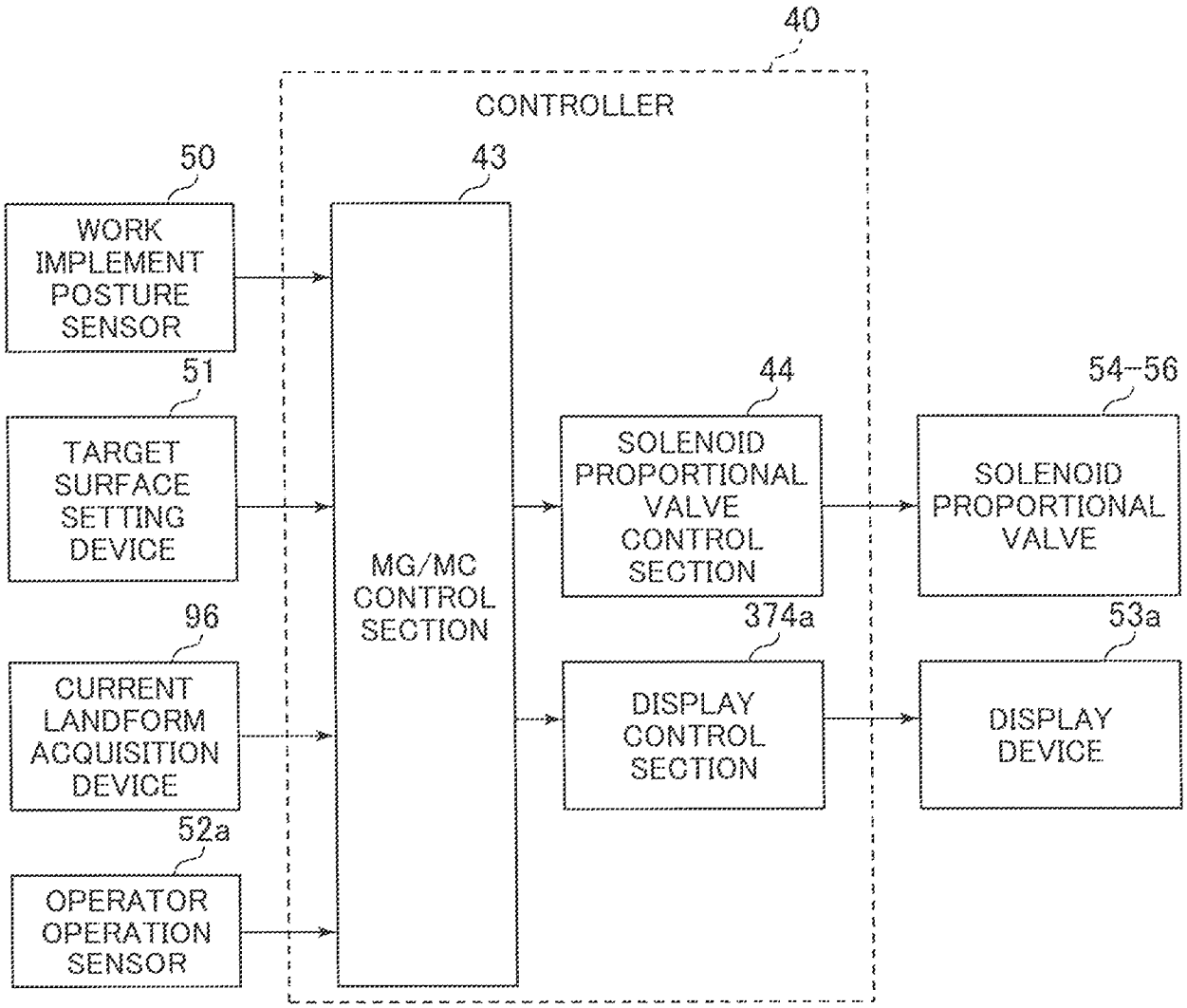
FIG. 6 is a functional block diagram of the controller 40 for the hydraulic excavator.

FIG. 6 is a functional block diagram of the controller 40. The controller 40 includes an MG/MC control section 43, a solenoid proportional valve control section 44, and a display control section 374*a*.

<MG/MC Control Section 43>

When the operation devices 45*a*, 45*b*, and 46*a* are operated, the MG/MC control section 43 performs MC for at least one of the hydraulic actuators 5, 6, and 7 in accordance with a predetermined condition. The MG/MC control section 43 in the present embodiment performs MC that controls an operation of at least either one of the boom cylinder 5 (boom 8) and the arm cylinder 6 (arm 9) such that the claw tip (control point) of the bucket 10 is located on the target surface 700 or a position superior to the target surface 700, on the basis of a position of the target surface 700, a posture of the front work implement 1A and a position of the claw tip of the bucket 10, and the operation amounts of the operation devices 45*a*, 45*b*, and 46*a*. The MG/MC control section 43 calculates target pilot pressures of the flow control valves 15*a*, 15*b*, and 15*c* of the respective hydraulic cylinders 5, 6, and 7 and outputs the calculated target pilot pressures to the solenoid proportional valve control section 44.

Figure 7:
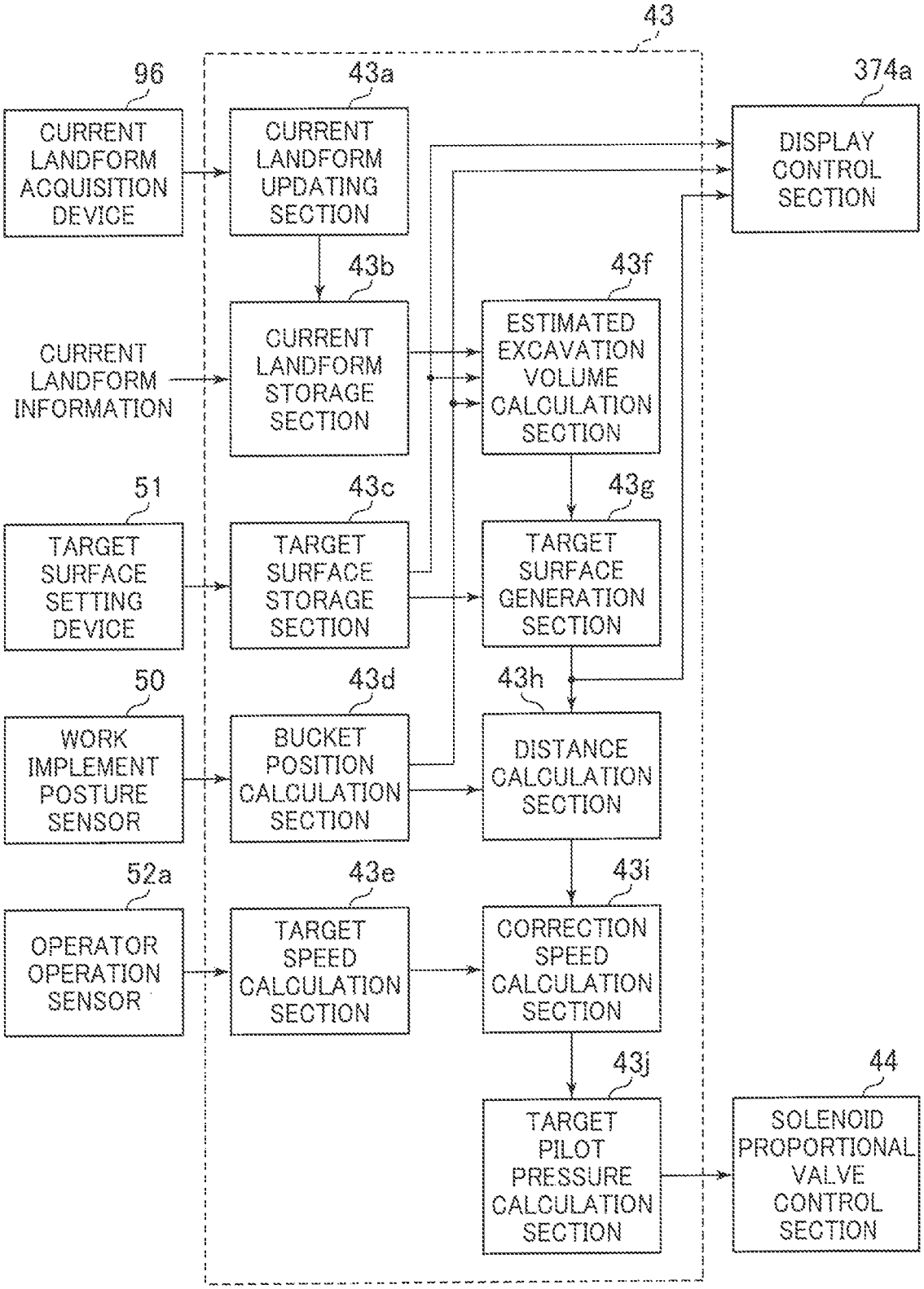
FIG. 7 is a functional block diagram of an MG/MC control section 43 illustrated in FIG. 6.

FIG. 7 is a functional block diagram of the MG/MC control section 43 illustrated in FIG. 6. The MG/MC control section 43 includes a current landform updating section 43*a*, a current landform storage section 43*b*, a target surface storage section 43*c*, a bucket position calculation section 43*d*, a target speed calculation section 43*e*, an estimated excavation volume calculation section 43*f*, a target surface generation section 43*g*, a distance calculation section 43*h*, a correction speed calculation section 43*i*, and a target pilot pressure calculation section 43*j*.

The current landform storage section 43*b* stores position information of the current landform around the hydraulic excavator (current landform data). The current landform data represents, for example, a point group having three-dimensional coordinate data acquired by the current landform acquisition device 96 at appropriate timing in the global coordinate system.

The current landform updating section 43*a* updates, when an estimated excavation volume Va (to be described later) is calculated by the estimated excavation volume calculation section 43*f*, the position information of the current landform stored in the current landform storage section 43*b* using position information of the current landform 800, which is acquired by the current landform acquisition device 96.

The target surface storage section 43*c* stores position information (target surface data) of the target surface (first target surface) 700, which is calculated using information from the target surface setting device 51. Reference is now made to FIG. 4. In the present embodiment, a cross-sectional shape cut by a plane (operating plane of the work implement) that represents a three-dimensional target surface over which the work implement 1A travels is used as the target surface 700 (two-dimensional target surface). It is noted that, while FIG. 4 illustrates one target surface 700, the target surface may exist in plurality. If a plurality of target surfaces exist, possible methods for setting the target surface include: setting a surface closest to the work implement 1A as the target surface; setting a surface disposed inferior to the bucket claw tip as the target surface; and selecting any surface as the target surface.

The bucket position calculation section 43*d* calculates a posture of the front work implement 1A in the local coordinate system (excavator coordinate system) and the position of the claw tip of the bucket 10 using information from the work implement posture sensor 50. As described previously, the position information ($X_{bk}$, $Z_{bk}$) of the claw tip of the bucket 10 (bucket position data) can be calculated using Expression (1) and Expression (2). In addition, on the basis of the coordinate of a machine body reference position PO and the machine body inclination angle θ in the global coordinate system, the current landform data and design surface data can be translated to a machine body coordinate system having the machine body reference position PO as the origin. An example based on the machine body coordinate system will be described below.

Figure 8:
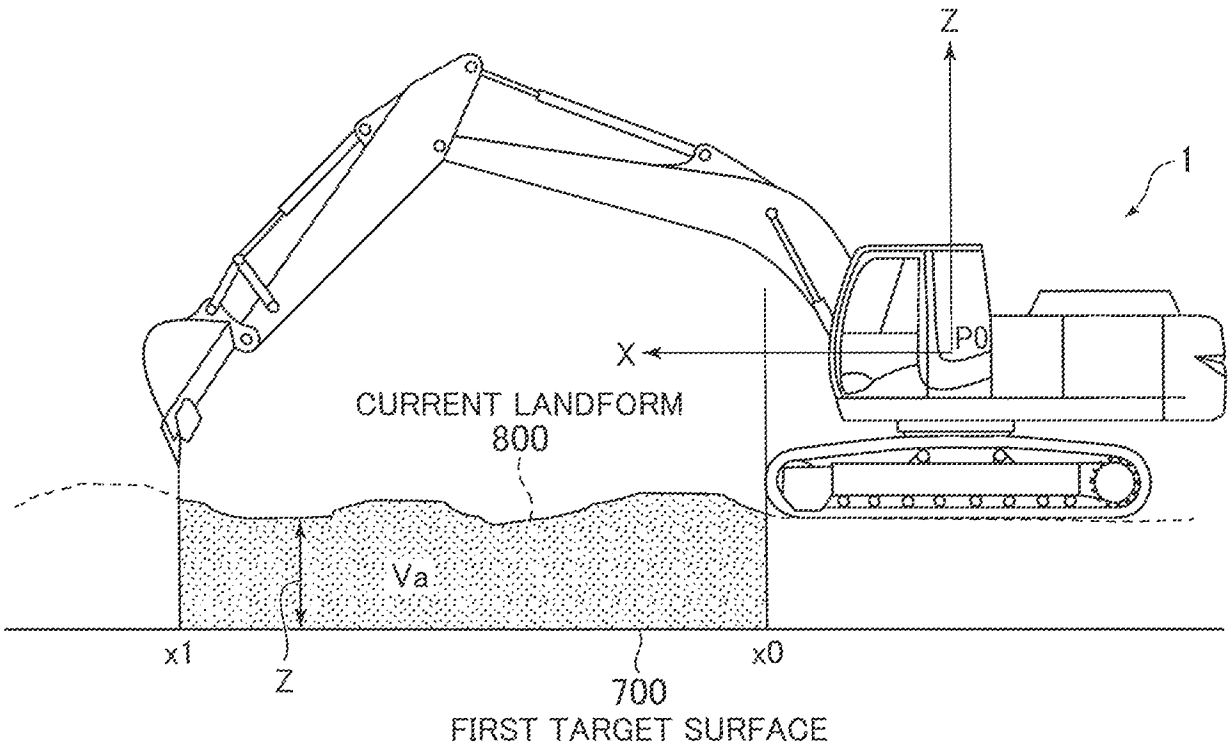
FIG. 8 is a side elevation view of a relation among a current landform 800, a target surface (first target surface) 700, and a hydraulic excavator 1.

The estimated excavation volume calculation section 43*f* calculates the estimated excavation volume Va on the basis of the current landform data, the target surface data, bucket position data, and an excavation end position set in advance (reference position x0 to be described later). The estimated excavation volume Va is a volume of a closed area defined by an X-coordinate of the bucket claw tip position (x1 to be described later), an X-coordinate of the bucket claw tip position at the excavation end set in advance (excavation end position) (reference position x0 to be described later), the current landform 800, the target surface 700, and the width of the bucket 10. FIG. 8 is a side elevation view of a relation among the current landform 800, the target surface (first target surface) 700, and the hydraulic excavator 1. The estimated excavation volume calculation section 43*f* calculates the volume Va (volume of the area shaded with dots in FIG. 8) of earth existing within a range of the reference position x0 set in advance as the excavation end position in the X-direction of the excavator coordinate system and a value x1 (=$X_{bk}$) of a bucket coordinate X calculated by the bucket position calculation section 43*d*, where x1 is $X_{bk}$ that is the X-coordinate of the bucket claw tip position obtained from Expression (1), and the reference position x0 is the X-coordinate of the bucket claw tip position at the excavation end, for which any value near the track structure 11 can be set. In the present embodiment, the reference position x0 is set to the X-coordinate of the frontmost portion in the lower track structure 11 when the upper swing structure 12 and the lower track structure 11 are aligned with each other in the anterior direction. At this time, the volume of earth (estimated excavation volume) Va can be obtained from Expression (3) given below. In this description, the reference position x0 (excavation end position) may be referred to as a "second position" as against a first position that is the bucket claw tip position at the excavation start (excavation start position).

[Math. 3]

$$Va = \int_{x0}^{x1} z dx \times w \quad \text{Expression (3)}$$

In Expression (3), z denotes a difference in Z-coordinate between a point on the current landform and a point on the target surface, the two points having identical X- and Y-coordinates, and w denotes the width of the bucket 10. While the present embodiment uses the bucket width w for simplified calculation, the estimated excavation volume Va may be obtained by integrating the point group of the current landform existing within the bucket width also in the Y-axis direction. The estimated excavation volume calculation section 43*f* outputs the estimated excavation volume Va to the target surface generation section 43*g*.

Figure 9:
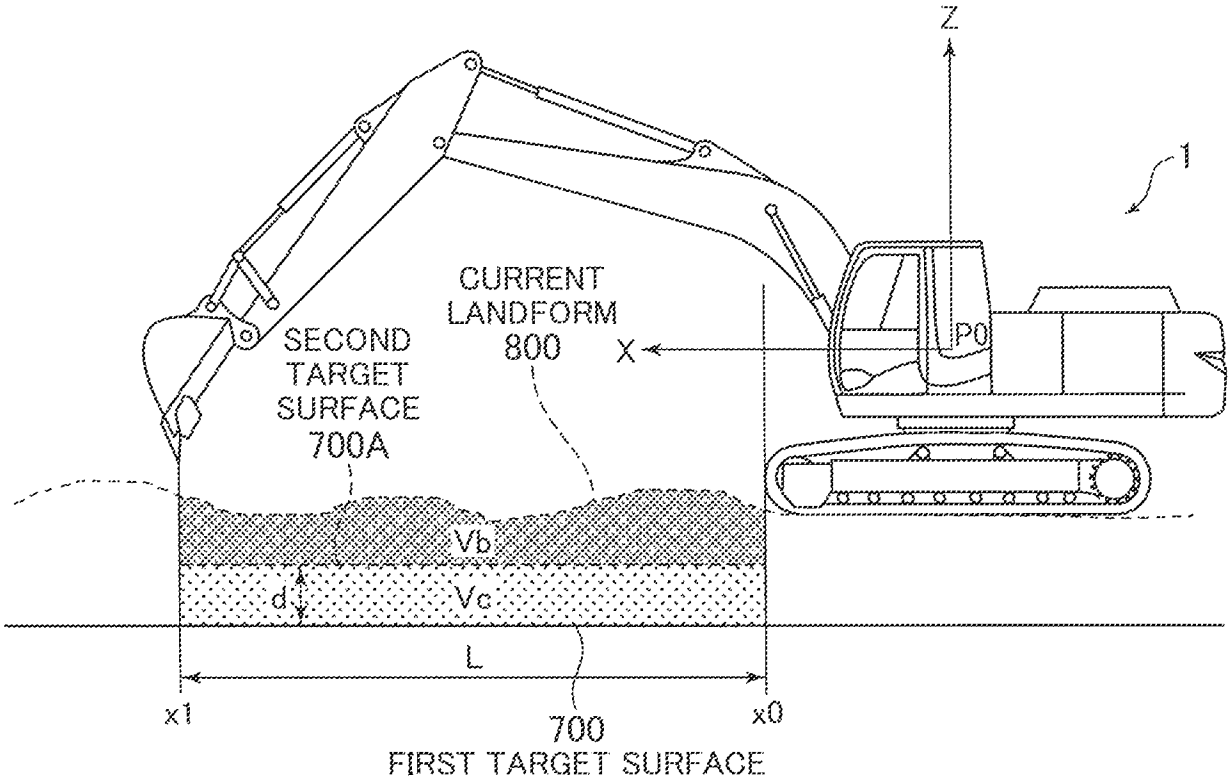
FIG. 9 is a side elevation view of a relation among a correction amount d, the first target surface 700, a second target surface 700A, and the hydraulic excavator 1.

When the estimated excavation volume Va exceeds a limit volume Vb set in advance, the target surface generation section 43*g* generates a new target surface (second target surface) 700A, which represents the first target surface 700 offset superiorly by a correction amount d. At this time, the target surface generation section 43*g* determines a height of the second target surface 700A by setting the correction amount d such that the volume of the closed area defined by the bucket claw tip position ($x1=X_{bk}$), the previously set excavation end position (x0), the current landform 800, the second target surface 700A, and the bucket width w is equal to or smaller than the limit volume Vb. FIG. 9 is a side elevation view of a relation among the correction amount d, the first target surface 700, the second target surface 700A, and the hydraulic excavator 1. The limit volume Vb can be set to any value that is maximum volume or smaller of an object that is to be excavated and that can be held by the bucket 10. The limit volume Vb is typically set to a value doubling the bucket capacity or smaller. The limit volume Vb may be said, from a work efficiency viewpoint, to be a target value of excavated volume (target excavated amount) to be housed in the bucket 10 during one excavation sequence by the work implement 1A.

Subtracting the limit volume Vb from the estimated excavation volume Va allows volume (to be referred to as correction volume) Vc required for reducing the estimated excavation volume Va to the limit volume Vb to be calculated using Expression (4) given below.

[Math. 4]

$$Vc = Va - Vb \quad \text{Expression (4)}$$

A relation among the correction volume Vc, an excavation distance L, the bucket width w, and the correction amount d may be expressed by Expression (5) given below.

[Math. 5]

$$Vc = L \times w \times d \quad \text{Expression (5)}$$

Here, the excavation distance L represents a difference in the X-coordinate between the bucket claw tip position and the excavation end position. The excavation distance L can be found by subtracting the reference position x0 from the bucket position information x1. By rearranging the above Expression (5), the correction amount d can be obtained, as in Expression (6) given below.

[Math. 6]

$$d = Vc/(L \times w) \quad \text{Expression (6)}$$

The target surface generation section 43*g* calculates the excavation distance L using, as the excavation start position (first position), the bucket claw tip position (x1) calculated by the bucket position calculation section 43*d* when the bucket claw tip position is located within a predetermined range from the current landform 800 and a crowding operation of the arm 6 (arm pull command) is input via the operation device 45*b*. The target surface generation section 43*g* then generates the second target surface 700A by offsetting the first target surface 700 superiorly by the correction amount d, which is obtained from the excavation distance L, the correction volume Vc, the bucket width w, and Expression (6) given above. When the estimated excavation volume Va is equal to or smaller than the limit volume Vb, the target surface generation section 43*g* does not generate the second target surface 700A and the MG/MC control section 43 performs MC on the basis of the first target surface 700.

Figure 10:
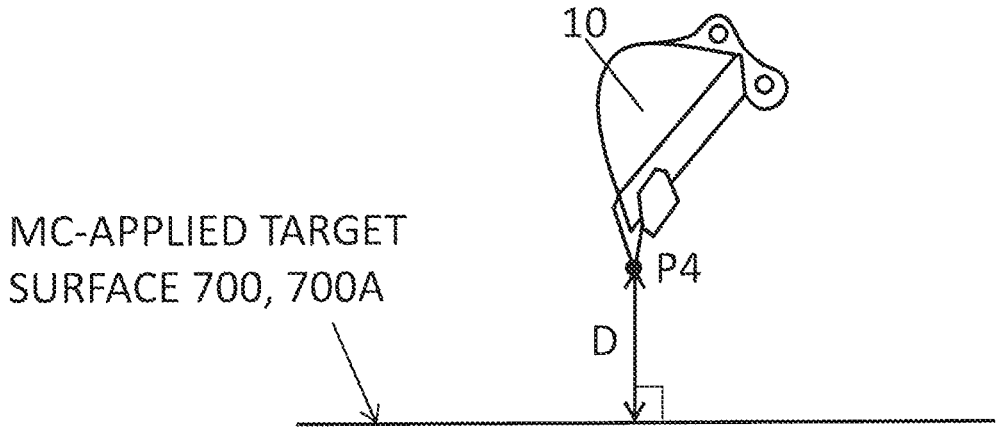
FIG. 10 is a diagram of a positional relation between a bucket claw tip P4 and the target surfaces 700 and 700A.

The distance calculation section 43*h* calculates a distance (target surface distance) D between a bucket claw tip P4 (see FIG. 10) and the first target surface 700 or the second target surface 700A, whichever is closer to the bucket claw tip P4 (which is an MC-applied target surface). Specifically, the target surface distance D represents a distance between P4 and the second target surface 700A when the second target surface 700A is generated by the target surface generation section 43*g*, and represents a distance between P4 and the first target surface 700 when the second target surface 700A is not generated by the target surface generation section 43*g*. FIG. 10 is a diagram illustrating a positional relation between the bucket claw tip P4 and the MC-applied target surfaces 700 and 700A. The distance between a foot of a vertical line extended from the bucket claw tip P4 to the MC-applied target surfaces 700 and 700A and the bucket position coordinate is the target surface distance D between the MC-applied target surfaces 700 and 700A and the bucket claw tip P4.

The target speed calculation section 43*e* calculates the operation amounts of the operation devices 45*a*, 45*b*, and 46*a* (operation levers 1*a* and 1*b*) on the basis of an input from the operator operation sensor 52*a*. On the basis of the operation amounts, the target speed calculation section 43*e* calculates target operating speeds of the boom cylinder 5, the arm cylinder 6, and the bucket cylinder 7. The operation amounts of the operation devices 45*a*, 45*b*, and 46*a* can be calculated from detection values of the pressure sensors 70, 71, and 72. Calculation of the operation amounts using the pressure sensors 70, 71, and 72 is illustrative only. The operation amount of the operation lever may be detected using a position sensor (e.g., rotary encoder) that detects rotational displacement of the operation lever for each of the operation devices 45*a*, 45*b*, and 46*a*. Still alternatively, instead of the configuration for calculating the operating speed from the operation amount, a possible configuration includes a stroke sensor that detects an extension or contraction amount of each of the hydraulic cylinders 5, 6, and 7 to thereby allow the operating speed of each cylinder to be calculated on the basis of changes over time in the detected extension or contraction amount.

The correction speed calculation section 43*i* calculates, on the basis of the target surface distance D output from the distance calculation section 43*h*, a correction factor k of a component V0*z* (vertical component) perpendicular to the target surface (the MC target surface that has been used for calculation of the target surface distance D, specifically, the target surface 700 or the target surface 700A) in a speed vector V0 of the bucket claw tip P4.

Figure 11:
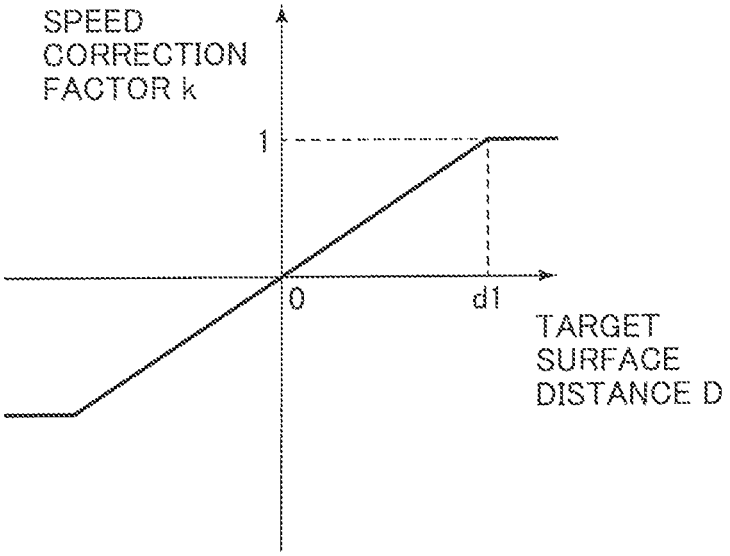
FIG. 11 is a graph illustrating a relation between a target surface distance D and a speed correction factor k.

FIG. 11 is a graph illustrating a relation between the target surface distance D and the speed correction factor k. The target surface distance D is assumed to be positive when the bucket claw tip P4 is located superior to the target surface. When the speed in a direction in which the bucket enters the target surface is assumed to be positive, the speed correction factor k decreases from 1 with decreasing the target surface distance D from a predetermined distance d1.

Figure 12:
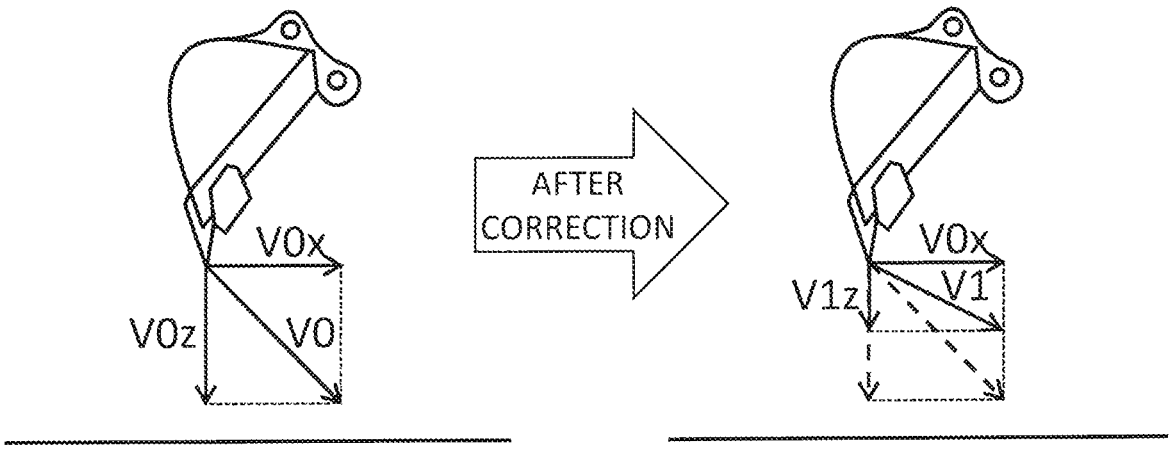
FIG. 12 is a diagram of a speed vector V0 at a bucket distal end.

FIG. 12 is a diagram illustrating the speed vector V0 at the bucket distal end. The correction speed calculation section 43*i* calculates the speed vector V0 of the bucket claw tip P4 on the basis of the actuator speed output from the target speed calculation section 43*e*. The bucket speed vector V0 is then decomposed into the vertical component V0*z* and a horizontal component V0*x* of the target surface and the vertical component V0*z* is multiplied by the correction factor k to obtain a correction speed V1*z*. The speed vector composed of the correction speed V1*z* and the horizontal component V0*x* of the original speed vector V0 assumes a speed vector V1 of the bucket claw tip P4 after the correction. This results in the following. The speed in the vertical direction of the speed vector at the bucket claw tip P4 approaches zero as the distance D approaches zero as a result of the bucket claw tip P4 approaching the target surface. Then, MC where the bucket claw tip P4 moves along the target surface is performed. When the bucket claw tip P4 operates in a direction in which the bucket claw tip P4 is spaced away from the target surface (specifically, the vertical component V0*z* is oriented superiorly), the speed correction factor k is invariably 1 regardless of the distance D. Thus, the speed in the boom raising operation is not reduced.

The target pilot pressure calculation section (control signal calculation section) 43*j* calculates the target speed of each of the hydraulic cylinders 5, 6, and 7 capable of being output by the speed vector V1 (V1*z*, V0*x*) of the bucket claw tip P4 after the correction. When, at this time, software has been programmed to perform MC that translates the distal end speed vector V0 to the target speed vector V1 through a combination of boom raising and arm crowding deceleration, a cylinder speed in the direction of extending the boom cylinder 5 and a cylinder speed in the direction of extending the arm cylinder 6 are calculated. The target pilot pressure calculation section 43*j* then calculates, on the basis of the calculated target speed of each of the cylinders 5, 6, and 7, a target pilot pressure (control signal) for each of the flow control valves 15*a*, 15*b*, and 15*c* of the hydraulic cylinders 5, 6, and 7. The target pilot pressure calculation section 43*j* then outputs the target pilot pressure for the corresponding one of the flow control valves 15*a*, 15*b*, and 15*c* of the hydraulic cylinders 5, 6, and 7 to the solenoid proportional valve control section 44.

<Solenoid Proportional Valve Control Section 44>

The solenoid proportional valve control section 44 calculates commands for solenoid proportional valves 54 to 56 on the basis of the target pilot pressures for the flow control valves 15*a*, 15*b*, and 15*c* output from the target pilot pressure calculation section 43*j*. It is noted that, when the pilot pressure based on an operator operation (first control signal) coincides with the target pilot pressure calculated by an actuator control section 81, the current value (command value) for the corresponding one of the solenoid proportional valves 54 to 56 is zero and the corresponding one of the solenoid proportional valves 54 to 56 is not operated.

<Display Control Section 374*a*>

The display control section 374*a* performs processing for displaying on the display device 53*a* a positional relation between the target surface 700 and the work implement 1A (claw tip of the bucket 10) on the basis of the posture information of the front work implement 1A, the position information of the claw tip of the bucket 10, and the position information of the target surface 700 that are input from MG/MC control section 43. This causes a display screen of the display device 53*a* to display the positional relation between the target surface 700 and the work implement 1A (claw tip of the bucket 10) as illustrated in FIG. 15.

<Flowchart for Setting the Target Surface by the MG/MC Control Section 43>

Figure 13:
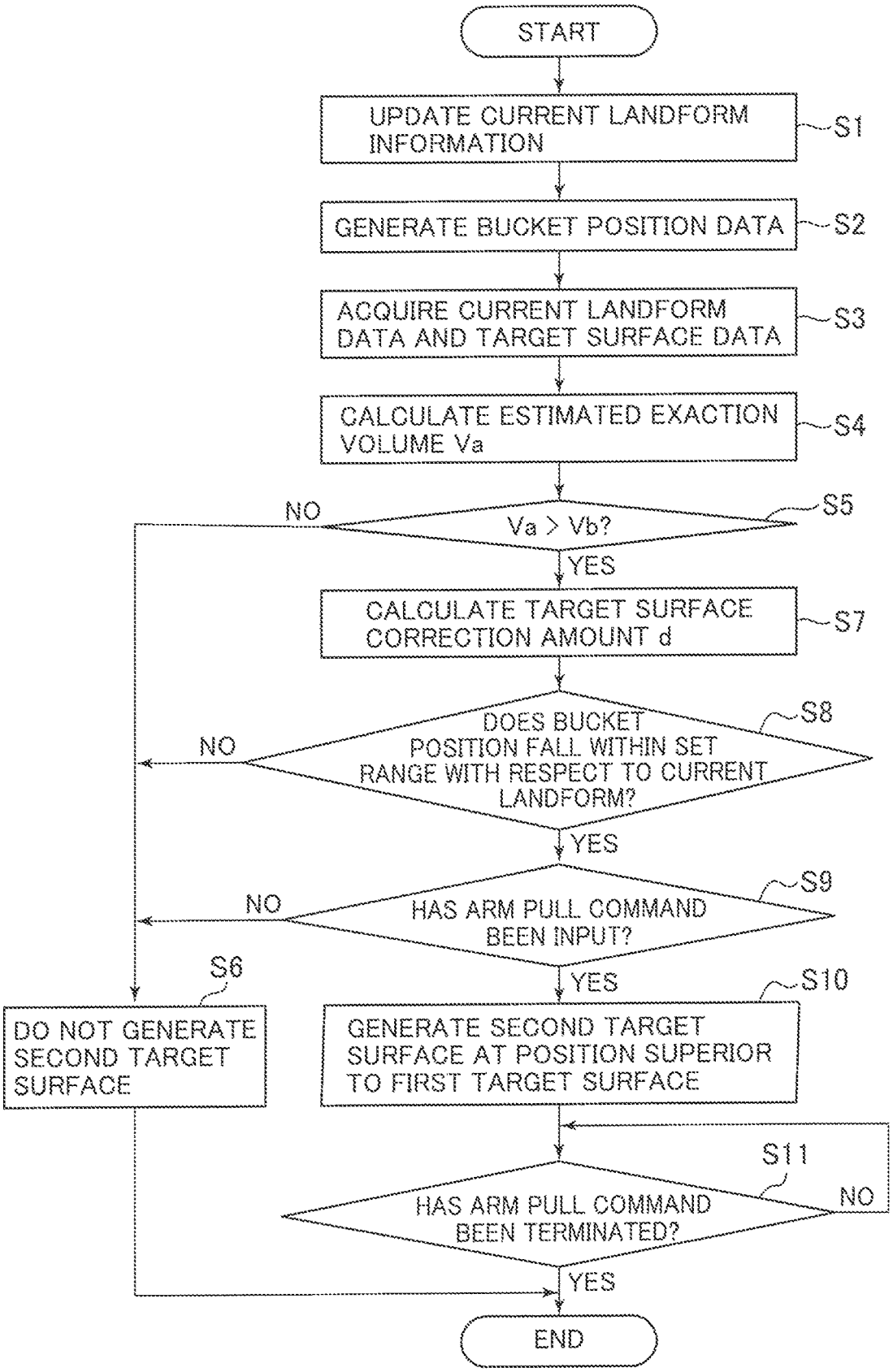
FIG. 13 is a flowchart for setting a target surface by the MG/MC control section 43.

FIG. 13 illustrates a flowchart through which the MG/MC control section 43 sets the target surface. The MG/MC control section 43 starts processing at predetermined control cycles and the current landform updating section 43*a* updates the position information of the current landform stored in the current landform storage section 43*b* using the latest position information of the current landform acquired by the current landform acquisition device 96 (Step S1).

The bucket position calculation section 43*d* calculates the bucket claw tip position ($X_{bk}$, $Z_{bk}$) on the basis of the information output from the work implement posture sensor 50 (Step S2).

The estimated excavation volume calculation section 43*f* acquires the current landform data and the first target surface data that fall within a predetermined range on the basis of the bucket claw tip position calculated at Step S2 (Step S3). The estimated excavation volume calculation section 43*f* then calculates the estimated excavation volume Va using the bucket claw tip position, the current landform data, and the first target surface data (Step S4).

The target surface generation section 43*g* determines whether the estimated excavation volume Va exceeds the limit volume Vb set in advance (Step S5). When it is determined at Step S5 that the estimated excavation volume Va does not exceed the limit volume Vb (specifically, the estimated excavation volume Va is equal to or smaller than the limit volume Vb), the target surface generation section 43*g* does not generate the second target surface 700A, so that the first target surface 700 assumes the MC target surface (MC-applied target surface) (Step S6).

On the other hand, when it is determined at Step S5 that the estimated excavation volume Va exceeds the limit volume Vb, the target surface generation section 43*g* calculates the correction amount d of the target surface (Step S7). Step S8 is then performed.

At Step S8, the target surface generation section 43*g* determines whether the bucket claw tip position ($X_{bk}$, $Z_{bk}$) is located within a predetermined range from the current landform 800. When it is determined by this determination that the bucket claw tip is located within the predetermined range, Step S9 is then performed. When it is determined by this determination that the bucket claw tip is located outside the predetermined range, Step S6 is then performed.

At Step S9, the target surface generation section 43*g* determines whether an arm pull command (arm crowding operation) has been input via the operation device 45*b*. When it is determined by this determination that the arm pull command has not been input, Step S6 is then performed. When it is determined by this determination that the arm pull command has been input, a surface offset by the correction amount d superiorly from the first target surface 700 is generated as the second target surface 700A (Step S10) and Step S11 is then performed. Step S10 sets the second target surface 700A as the MC target surface (MC-applied target surface).

At Step S11, the target surface generation section 43*g* determines whether the input of the arm pull command is terminated. As long as the arm pull command continues, use of the second target surface 700A corrected at Step S10 in MC is maintained. On the other hand, when the arm pull command is terminated, use of the second target surface 700A in MC is terminated.

<Flowchart for MC by the MG/MC Control Section 43>

Figure 14:
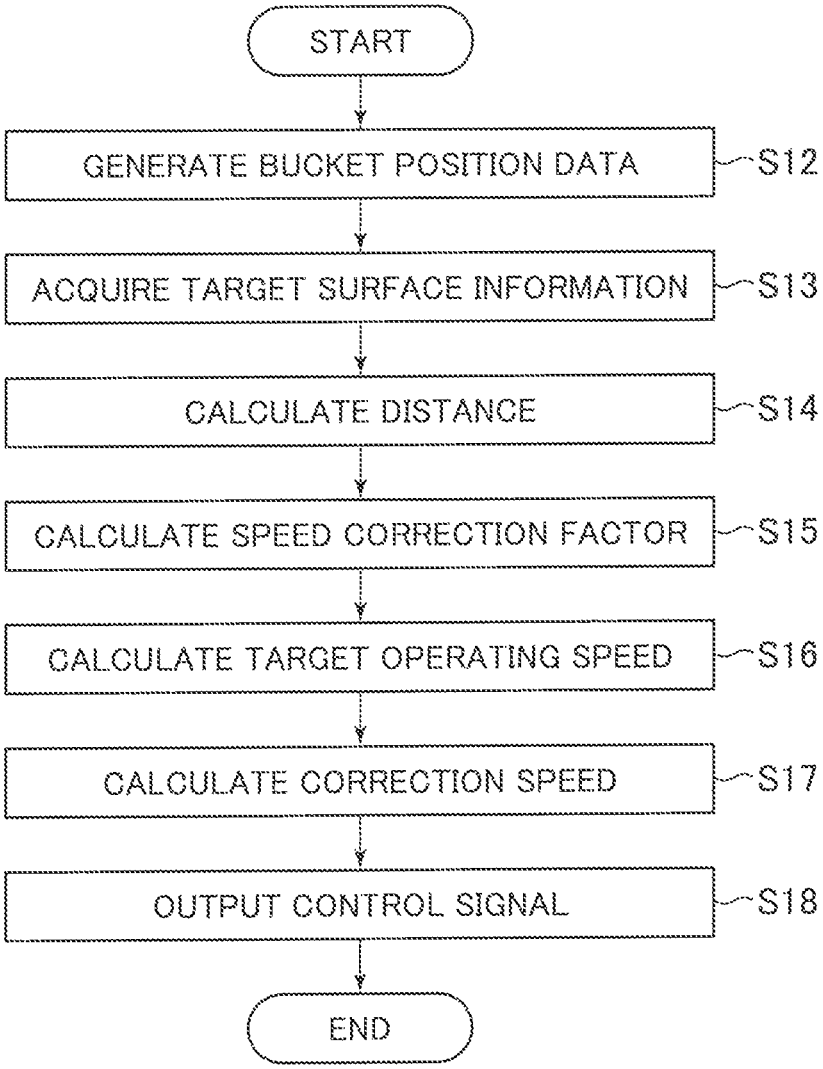
FIG. 14 is a flowchart for MC by the MG/MC control section 43.

FIG. 14 is a flowchart for MC by the MG/MC control section 43. When any one of the operation devices 45*a*, 45*b*, and 46*a* is operated by the operator, the MG/MC control section 43 starts processing illustrated in FIG. 13. The bucket position calculation section 43*d* calculates the bucket claw tip position (bucket position data) on the basis of the information from the work implement posture sensor 50 (Step S12).

At Step S13, the distance calculation section 43*h* acquires the position information (target surface data) of the first target surface 700 or the second target surface 700A set as the MC-applied target surface by the flowchart of FIG. 13 from the target surface generation section 43*g*. At Step S14, the distance calculation section 43*h* calculates the target surface distance D using the bucket position data calculated at Step S12 and the target surface data acquired at Step S13.

At Step S15, the correction speed calculation section 43*i* calculates the speed correction factor k ($-1 \leq k \leq 1$) of the component V0*z* perpendicular to the MC-applied target surface in the speed vector V0 of the bucket claw tip P4 using the target surface distance D calculated at Step S14.

At Step S16, the target speed calculation section 43*e* calculates the operation amounts of the operation devices 45*a*, 45*b*, and 46*a* (operation levers 1*a* and 1*b*) using the input from the operator operation sensor 52*a* and, on the basis of the operation amounts, and calculates the target operating speeds of the boom cylinder 5, the arm cylinder 6, and the bucket cylinder 7.

At Step S17, the correction speed calculation section 43*i* calculates the speed vector V0 of the bucket claw tip P4 using each actuator speed calculated at Step S16. The bucket speed vector V0 is then decomposed into the vertical component V0*z* and the horizontal component V0*x* of the target surface and the vertical component V0*z* is multiplied by the correction factor k to obtain the correction speed V1*z*. The correction speed calculation section 43*i* combines the correction speed V1*z* with the horizontal component V0*x* of the original speed vector V0 to thereby calculate the corrected speed vector V1 of the bucket claw tip P4.

At Step S18, the target pilot pressure calculation section 43*j* calculates the target speed of each of the hydraulic cylinders 5, 6, and 7 on the basis of the corrected speed vector V1 (V1*z*, V0*x*) calculated at Step S17. The target pilot pressure calculation section 43*j* then calculates target pilot pressures for the flow control valves 15*a*, 15*b*, and 15*c* of the respective hydraulic cylinders 5, 6, and 7 on the basis of the calculated target speeds of the hydraulic cylinders 5, 6, and 7 and outputs the target pilot pressures to the solenoid proportional valve control section 44. MC is thereby performed so as to control an operation of at least one of the hydraulic cylinders 5, 6, and 7 such that the bucket claw tip is located on or superior to the target surface 700.

<Operation and Effects>

The hydraulic excavator 1 configured as described above performs processing in accordance with the flowchart of FIG. 13 to calculate, at predetermined control cycles, the estimated excavation volume Va, which is defined by the bucket claw tip position (x1=Xd) at that particular point in time, the previously set excavation end position (x0 (second position)), the current landform 800, the first target surface 700, and the bucket width w (Steps S1 to S4). When the estimated excavation volume Va is greater than the limit volume Vb, the correction amount d is then calculated such that the volume defined by the bucket claw tip position (x1) at that particular point in time, the previously set excavation end position (x0), the current landform 800, the second target surface 700A, which is the first target surface 700 set back superiorly by the correction amount d, and the bucket width w is the limit volume Vb (Steps S5 to S7).

An excavation operation is typically started by the hydraulic excavator 1 with the input of an arm pull command (crowding operation of the arm 6) via the operation device 45*b* under a condition in which the bucket claw tip is moved on the current landform to a position away from the machine body 1B through raising and lowering operations of the boom 5 and dumping operations of the arm 6. Specifically, the bucket claw tip can be considered to be located on the current landform when the arm pull command is input and the excavation operation can be considered to be started from that position. Thus, in the present embodiment, when the estimated excavation volume Va is greater than the limit volume Vb, it is determined at Step S9 whether the arm pull command is input and, when it is determined that the arm pull command is input, the second target surface 700A is generated on the assumption that the bucket claw tip position at that point in time is the excavation start position (first position) (Step S10).

Thus, when the estimated excavation volume Va is greater than the limit volume Vb at the excavation start (at the start of the arm crowding operation), the second target surface 700A is generated at a position at which the estimated excavation volume is Vb with reference to the excavation start position (first position) and the second target surface 700A is set as the MC-applied target surface (processing by way of Step S10 in FIG. 13 is performed). On the other hand, when the estimated excavation volume Va is equal to or smaller than the limit volume Vb, the first target surface 700 is set as the MC-applied target surface (processing by way of Step S6 in FIG. 13 is performed).

When excavation work is performed as described above using the work implement 1A through the input of the arm crowding operation via the operation device 45*b* under a condition in which the MC-applied target surface can be set as appropriate in accordance with the estimated excavation volume Va, the MG/MC control section 43 follows the steps of the flowchart of FIG. 14 to perform the MC that controls at least one of the hydraulic actuators 5, 6, and 7 such that the vertical component (component perpendicular to the target surface 700) of the speed vector of the claw tip is reduced as the claw tip gets closer to the MC-applied target surface, during a period of time over which the claw tip of the bucket 10 moves through the deceleration area 600 by the arm crowding operation. As a result, the vertical component of the speed vector of the claw tip is zero on the MC-applied target surface, so that the operator can perform excavation along the MC-applied target surface by simply inputting the arm crowding operation. Load on the operator during the excavation work can thereby be reduced. During this excavation work, the flowchart of FIG. 13 ensures that the target surface is determined in accordance with the bucket claw tip position (first position) at the excavation start such that the excavation amount is always equal to or smaller than the limit volume Vb. Thus, even with the excavation start position (first position) varying among different excavation operations (specifically, even when the excavation distance L varies for each excavation operation), the actual excavation amount can be prevented from exceeding the limit volume Vb.

Specifically, in accordance with the present embodiment, the estimated excavation volume Va is calculated on the basis of the posture of the hydraulic excavator 1 at the excavation start and the MC-applied target surface is generated such that the actual excavation amount is always equal to or smaller than the limit volume Vb, so that the MC-applied target surface can be generated at an appropriate position even when the excavation distance L varies and the actual excavation amount can be prevented from exceeding the limit volume Vb (e.g., maximum bucket capacity).

Additionally, at this time, the front work implement 1A is controlled such that the bucket 10 is prevented from entering an area beneath the MC-applied target surface and the bucket 10 operates along the MC-applied target surface, so that operating load on the operator during the excavation work can be reduced. Specifically, when, for example, the first target surface is set as a design surface indicating the final shape of the object to be worked on and the limit volume Vb is set to the maximum bucket capacity, the excavation work can be performed, in which the design surface is not damaged under a condition in which the excavation amount in one excavation operation is held within the maximum bucket capacity.

The present embodiment has been described for an example in which the current landform is acquired by the current landform acquisition device 96 mounted in the hydraulic excavator 1. A current landform acquisition device may nonetheless be prepared independently of the hydraulic excavator 1, as with a drone, for example, in which a laser scanner is mounted as the current landform acquisition device for acquiring the current landform information and the current landform information acquired by such a current landform acquisition device may be input and used.

<Another Embodiment (Modification of the Current Landform Updating Section)

Another embodiment of the present invention will be described below. A hydraulic excavator in the present embodiment is identical to the hydraulic excavator in the preceding embodiment except that a controller in the hydraulic excavator in the present embodiment (more specifically, details of processing performed by the current landform updating section) differs from the controller in the preceding embodiment. The following describes only the differences from the preceding embodiment.

Figure 16:
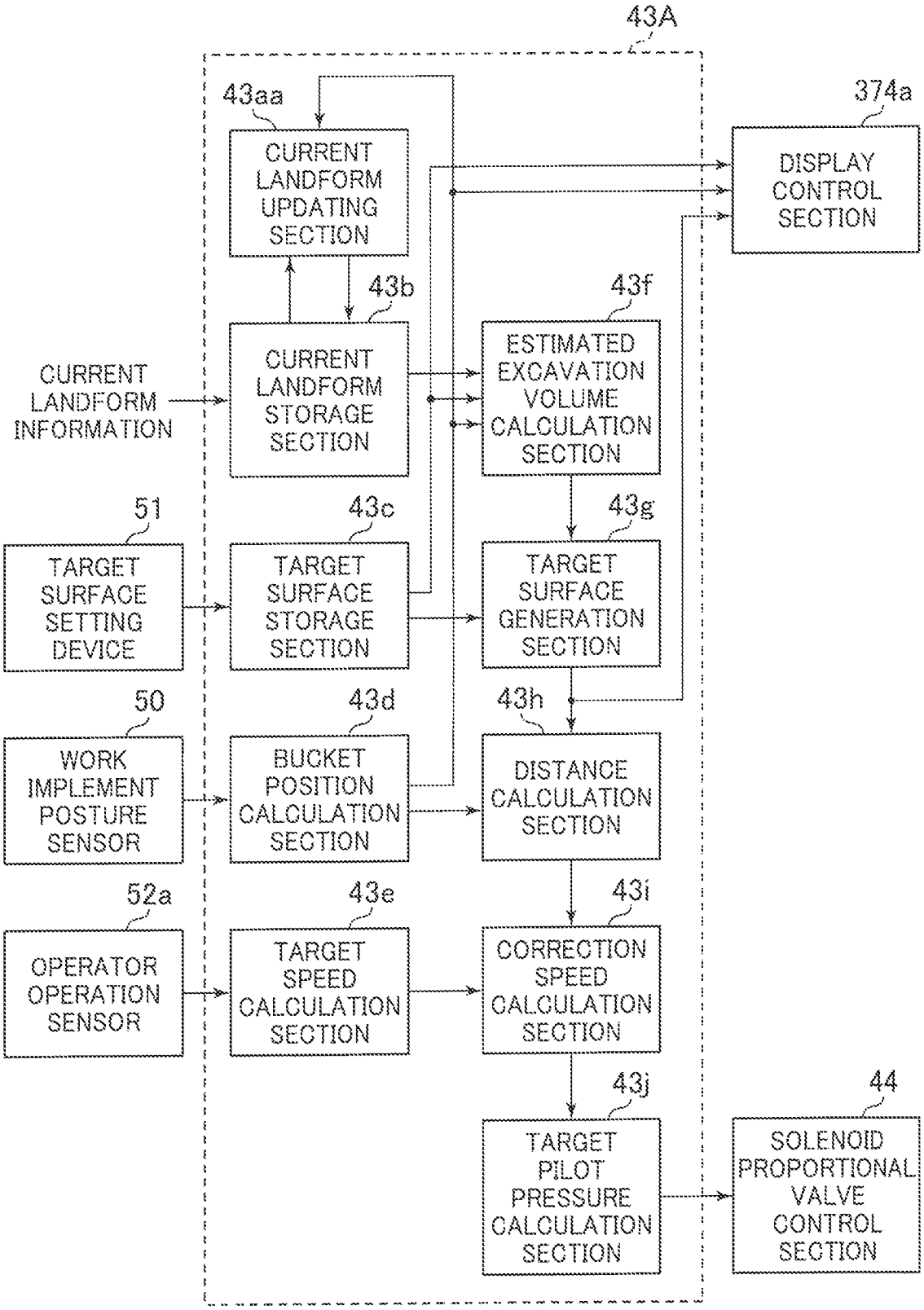
FIG. 16 is a functional block diagram of an MG/MC control section 43A according to another embodiment.

FIG. 16 is a functional block diagram of an MG/MC control section 43A according to the present embodiment. The MG/MC control section 43A in the present embodiment differs from the MG/MC control section 43 of the preceding embodiment in that the MG/MC control section 43A includes a current landform updating section 43*aa*.

Position information of the current landform stored in the current landform storage section 43*b* and position information of the bucket claw tip calculated by the bucket position calculation section 43*d* are input to the current landform updating section 43*aa*. When the position of the bucket claw tip calculated by the bucket position calculation section 43*d* is inferior to the position of the current landform stored in the current landform storage section 43*b*, the position information of the current landform stored in the current landform storage section 43*b* is updated with the position information of the bucket claw tip calculated by the bucket position calculation section 43*d*. On the other hand, when the position of the bucket claw tip calculated by the bucket position calculation section 43*d* is superior to the position of the current landform stored in the current landform storage section 43*b*, the position information of the current landform stored in the current landform storage section 43*b* is not updated. Specifically, in the present embodiment, a trajectory drawn by the bucket claw tip during excavation of the current landform is regarded as the current landform after the excavation and the current landform data is updated accordingly.

Figure 17:
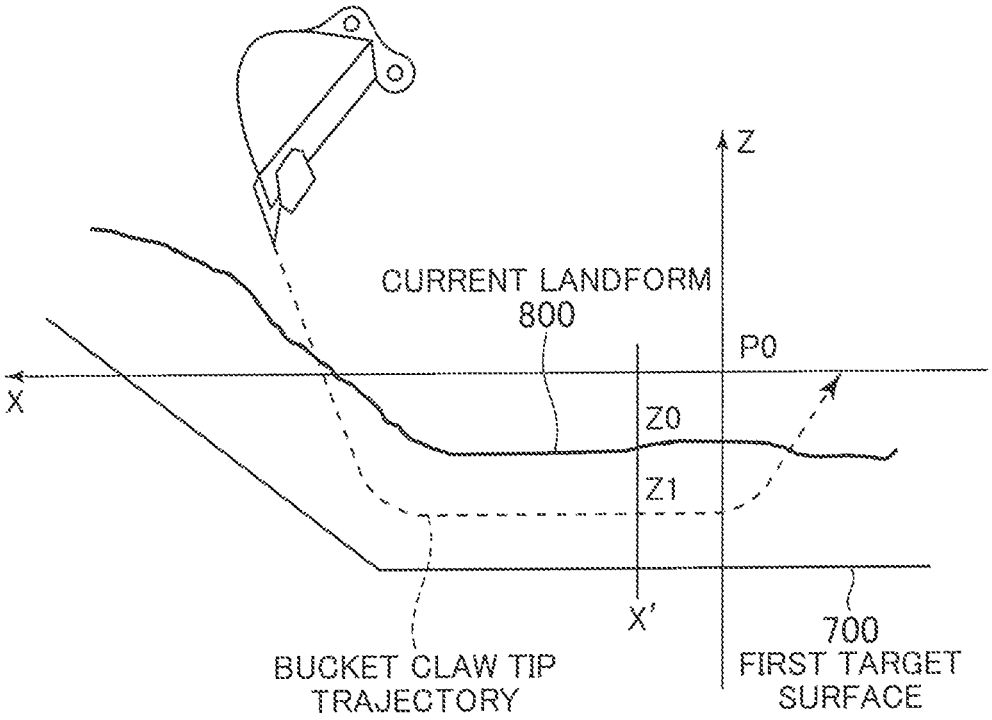
FIG. 17 is a schematic diagram illustrating updating of a current landform performed by a current landform updating section 43*aa* on the basis of position information of the bucket claw tip.

FIG. 17 is a schematic diagram illustrating updating of the current landform performed by the current landform updating section 43*aa* on the basis of the position information of the bucket claw tip. At a coordinate x' in the horizontal direction, a coordinate z1 in the bucket height direction is compared with a coordinate z0 in the current landform height direction. When z1 is inferior to z0, z1 is updated as new current landform data.

Such use of the bucket claw tip position information for updating the current landform eliminates the need for the current landform acquisition device 96 to acquire the current landform data for each excavation sequence, so that time required for acquisition of the current landform data can be shortened. In addition, once the current landform data is acquired, the current landform data is thereafter updated sequentially by an updating function of the current landform updating section 43*aa*. This can eliminate the current landform acquisition device 96 from the hydraulic excavator 1.

Others

The first target surface 700 described above may be considered as a design surface defining a final excavation work shape.

Figure 18:
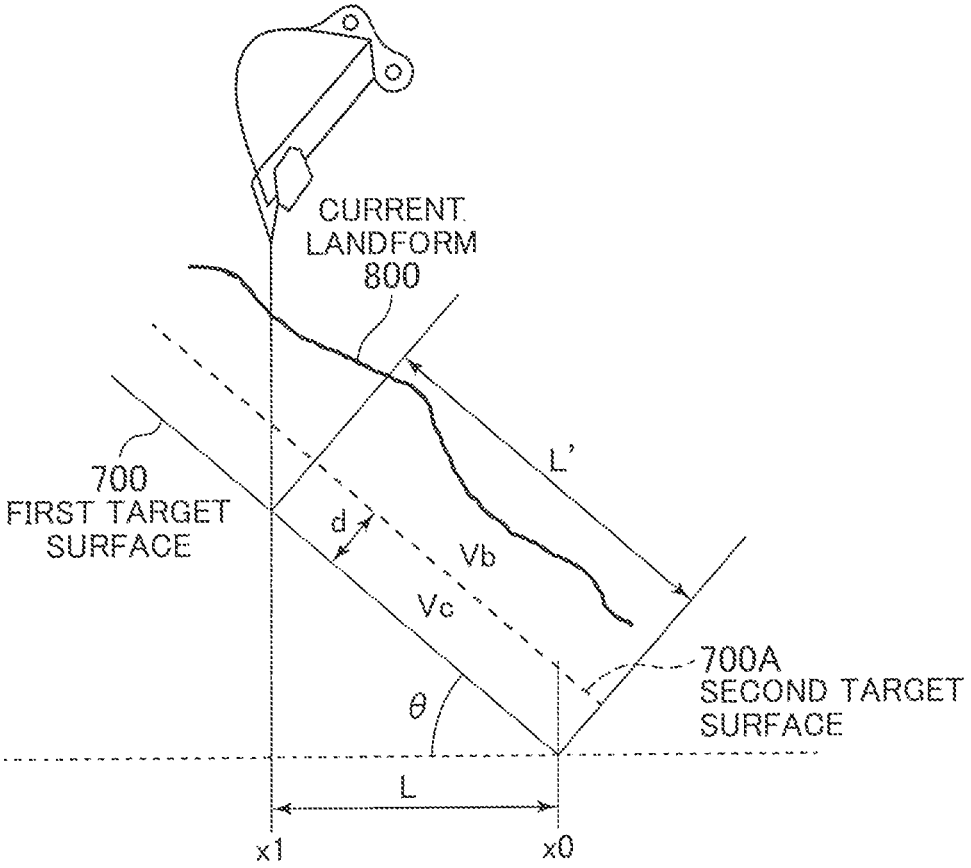
FIG. 18 is a schematic diagram illustrating a method for generating the second target surface 700A when the first target surface 700 is inclined with respect to an excavator coordinate.

When the first target surface 700 is inclined with respect to an excavator coordinate, the correction amount d may be calculated as follows to thereby generate the second target surface 700A. FIG. 18 is a schematic diagram illustrating a method for generating the second target surface 700A when the first target surface 700 is inclined with respect to the excavator coordinate. When the first target surface 700 is inclined only by θ relative to the horizontal direction, an excavation distance L' extending along the first target surface direction can be obtained with Expression (7) given below, using the distance L in the horizontal direction in the excavator coordinate.

[Math. 7]

$$L' = \frac{L}{\cos\theta} \qquad \text{Expression (7)}$$

Use of the excavation distance L' in the first target surface direction as L in Expression (6) allows the correction amount d of the first target surface 700 to be calculated as in a case in which the first target surface 700 is not inclined.

Figure 19:
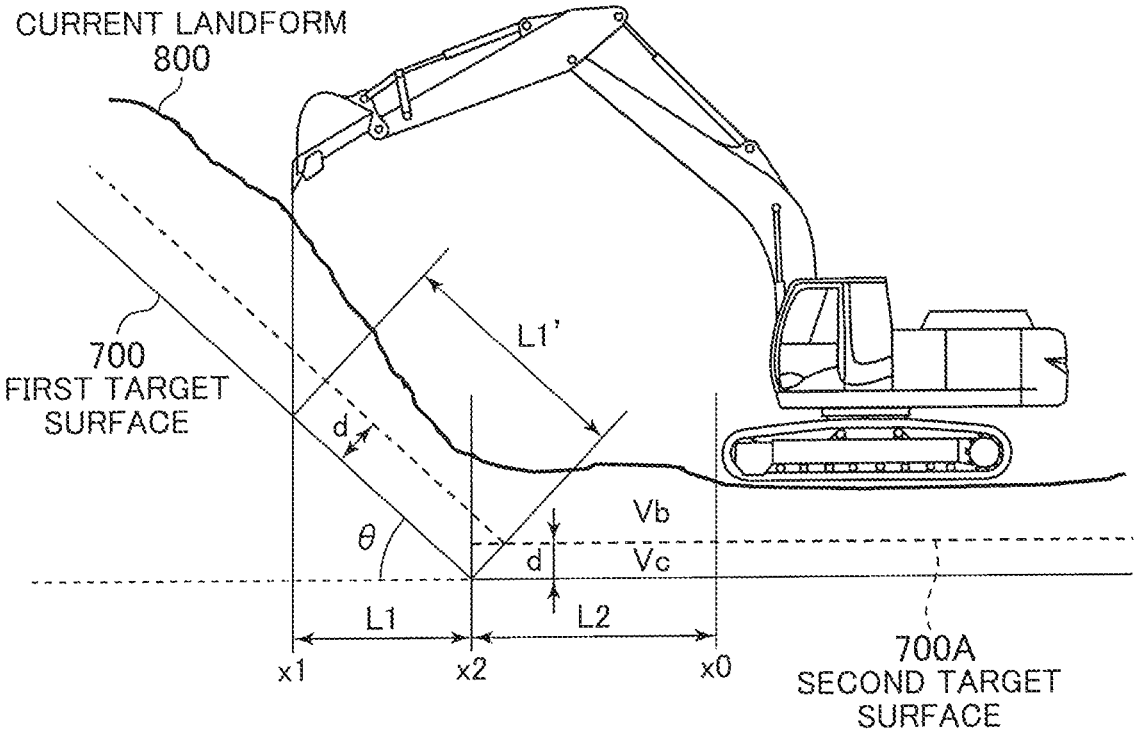
FIG. 19 is a schematic diagram illustrating a method for generating the second target surface 700A when the first target surface 700 is formed of a plurality of surfaces having different inclinations from each other.

When the first target surface 700 is formed of a plurality of surfaces having different inclinations from each other, the second target surface 700A may be generated through calculation of the correction amount d as follows. FIG. 19 is a schematic diagram illustrating a method for generating the second target surface 700A when the first target surface 700 is formed of a plurality of surfaces having different inclinations from each other. Consider a case in which the first target surface 700 is formed of the surfaces as illustrated in FIG. 19 and let x2 denote a coordinate extending in the horizontal direction, at which the first target surface 700 changes inclination angles. The correction amount d can be calculated through the following procedure. Specifically, for L in Expression (6), use a sum (L2+L1') of the excavation distance L2 over a range in which the first target surface 700 extends horizontally and the excavation distance L1' over a range in which the first target surface 700 is inclined, as against a sum of an estimated excavation volume Vat for the range in which the first target surface 700 extends horizontally and an estimated excavation volume Val for the range in which the first target surface 700 is inclined.

In addition, the above embodiment solves the problem through the following approach. Specifically, when the estimated excavation volume Va calculated on the basis of the position of the original target surface (first target surface 700) exceeds a desired limit volume Vb, a new target surface (second target surface 700A) is generated at a position superior to the original target surface (first target surface 700), to thereby bring the volume calculated on the basis of the position of the new target surface close to the limit volume Vb. The hydraulic excavator may nonetheless be configured such that the target surface is set directly at a position at which the estimated excavation volume to be excavated by one excavation sequence matches, or is close to, the limit volume Vb.

Specifically, in the hydraulic excavator including the work implement 1A including the bucket 10, the arm 9, and the boom 8; a plurality of the hydraulic actuators 5, 6, and 7 that drive the work implement 1A; the operation devices 45*a*, 45*b*, and 46*a* that instruct the respective hydraulic actuators 5, 6, and 7 on operations; and the controller 43 which includes the current landform storage section 43*b* for storing the position information of the current landform 800 and the bucket position calculation section 43*d* for calculating the position of the claw tip of the bucket 10, the controller 43 further includes the target surface generation section 43*g* that generates the target surface at a position at which the excavation volume defined by the first position that assumes the position of the claw tip of the bucket calculated by the bucket position calculation section 43*d* at the excavation start, the second position that assumes the position of the claw tip of the bucket at the excavation end set in advance, the current landform 800, the target surface, and the width w of the bucket is closer to the limit volume Vb set in advance, and the controller 43 may preferably control the hydraulic actuators 5, 6, and 7 such that, during the operations of the operation devices 45*a*, 45*b*, and 46*a*, an operating range of the work implement 1A is limited on the target surface and to the area superior to the target surface.

It is noted that the correction factor k specified in FIG. 11 is illustrative only and may take any value that results in the vertical component V0*z* of the speed vector approaching 0 at the target surface distance D in the positive range approaching 0.

It should be noted that the present invention is not limited to the above-described embodiments and may include various modifications without departing from the scope and spirit of the present invention. For example, the entire detailed configuration of the embodiments is not always necessary to embody the present invention and part of the configuration may be deleted. Part of the configuration of one embodiment may be replaced with the configuration of another embodiment, or the configuration of one embodiment may be combined with the configuration of another embodiment.

DESCRIPTION OF REFERENCE CHARACTERS

1A: Front work implement
5: Boom cylinder
6: Arm cylinder
7: Bucket cylinder
8: Boom
9: Arm
10: Bucket
30: Boom angle sensor
31: Arm angle sensor
32: Bucket angle sensor
40: Controller
43: MG/MC control section
43*a*: Current landform updating section
43*b*: Current landform storage section (storage section)
43*c*: Target surface storage section
43*d*: Bucket position calculation section
43*e*: Target speed calculation section
43*f*: Estimated excavation volume calculation section
43*g*: Target surface generation section
43*h*: Distance calculation section
43*i*: Correction speed calculation section
43*j*: Target pilot pressure calculation section
44: Solenoid proportional valve control section
45: Operation device (boom, arm)
46: Operation device (bucket, swing)
50: Work implement posture sensor
51: Target surface setting device
53*a*: Display device
54, 55, 56: Solenoid proportional valve
96: Current landform acquisition device
374*a*: Display control section
700: First target surface
700A: Second target surface
800: Current landform

The invention claimed is:

1. A work machine comprising:

a work implement having a bucket, an arm, and a boom;

a plurality of hydraulic actuators that drive the work implement;

operation devices that instruct the hydraulic actuators on operations;

posture sensors that detect a posture of the work implement; and a controller configured to control the hydraulic actuators such that, during operations of the operation devices, an operating range of the work implement is limited on a predetermined first target surface and to an area superior to the first target surface, wherein the controller stores position information of a current landform, the controller is configured to:

calculate a position of a claw tip of the bucket based on detection values from the posture sensors;

calculate an estimated excavation volume of earth existing within a range of between a first position that assumes the position of the claw tip of the bucket at an excavation start and a second position that is set in advance as the position of the claw tip of the bucket at an excavation end, based on the first position, the second position, the position information of the current landform, the first target surface, and a width of the bucket;

when the estimated excavation volume is equal to or smaller than a limit volume set in advance, control the hydraulic actuators such that an operating range of the work implement is limited on the first target surface and to the area superior to the first target surface;

generate, when the estimated excavation volume exceeds the limit volume, a second target surface at a position superior to the first target surface in order to reduce an excavation volume by the bucket to the limit volume or less, and control the hydraulic actuators such that the operating range of the work implement is limited on the second target surface and to an area superior to the second target surface.

2. The work machine according to claim 1, wherein the first position is the position of the claw tip of the bucket calculated when a crowding operation of the arm is input via the operation device.

3. The work machine according to claim 1, further comprising:

a current landform acquisition device that acquires the position information of the current landform, wherein the controller further configured to update, when the estimated excavation volume is calculated, the position information of the current landform stored using the position information of the current landform.

4. The work machine according to claim 1, wherein the controller further configured to update, when the position of the claw tip of the bucket calculated is disposed inferior to a position of the current landform stored, the position information of the current landform stored using position information of the claw tip of the bucket.

5. The work machine according to claim 1, wherein the limit volume is equal to or smaller than a double capacity of the bucket.

* * * * *